US007690754B2

(12) United States Patent
Nakamura et al.

(10) Patent No.: US 7,690,754 B2
(45) Date of Patent: Apr. 6, 2010

(54) INKJET PRINTER HEAD AND INKJET PRINTER

(75) Inventors: Hirotake Nakamura, Nagoya (JP); Seiji Shimizu, Oogaki (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 200 days.

(21) Appl. No.: 11/823,342

(22) Filed: Jun. 27, 2007

(65) Prior Publication Data

US 2008/0049063 A1 Feb. 28, 2008

Related U.S. Application Data

(63) Continuation of application No. 11/004,737, filed on Dec. 3, 2004, now Pat. No. 7,252,369.

(30) Foreign Application Priority Data

Dec. 4, 2003 (JP) ..... 2003-405972
Dec. 4, 2003 (JP) ..... 2003-405973
Dec. 22, 2003 (JP) ..... 2003-424453

(51) Int. Cl.
*B41J 2/015* (2006.01)

(52) U.S. Cl. ..... 347/20

(58) Field of Classification Search ..... 347/20, 347/49, 92, 37
See application file for complete search history.

(56) References Cited

U.S. PATENT DOCUMENTS 5,402,159 A 3/1995 Takahashi et al.

(Continued)

FOREIGN PATENT DOCUMENTS

EP 1288000 3/2003

(Continued)

OTHER PUBLICATIONS

Patent Abstracts of Japan, Ito Hirosumi, Appln No. 2002-037493, Feb. 14, 2002 (machine translation).

(Continued)

*Primary Examiner*—Matthew Luu
*Assistant Examiner*—Lisa M Solomon
(74) *Attorney, Agent, or Firm*—Day Pitney LLP

(57) ABSTRACT

An inkjet printer head including: (a) a front head unit having (a-i) an outside surface which is to be opposed to a print media, (a-ii) an inside surface opposite to the outside surface, (a-iii) a plurality of nozzles opening in the outside surface and arranged in row, and (a-iv) an ink inlet opening in the inside surface; (b) an ink-channel defining unit supplying an ink into the front head unit through the ink inlet; (c) a head holder holding the front head unit; and (d) a reinforcement member fixed to the inside surface of the front head unit. The front head unit and the head holder are fixed to each other, with the reinforcement member being interposed therebetween. The ink-channel defining unit is fixed to one of opposite side surfaces of the reinforcement member that is remote from the front head unit. Also disclosed is an inkjet printer including the above-described inkjet printer head, a carriage, a heat dissipater and a bubble discharger, wherein the heat dissipater, bubble discharger and front head unit are mounted on the carriage, and are arranged in a direction of movement of the carriage.

8 Claims, 16 Drawing Sheets

U.S. PATENT DOCUMENTS

| | | | | |
|---|---|---|---|---|
| 5,748,214 | A | 5/1998 | Usui et al. | |
| 6,652,081 | B2 | 11/2003 | Shimizu | |
| 2002/0105567 | A1 * | 8/2002 | Yamada et al. | 347/87 |

FOREIGN PATENT DOCUMENTS

| | | |
|---|---|---|
| EP | 1336497 | 8/2003 |
| JP | 4341 853 | 11/1992 |
| JP | H5-318755 | 12/1993 |
| JP | 8 276586 | 10/1996 |
| JP | H9-85945 | 3/1997 |
| JP | 2000 103084 | 4/2000 |
| JP | 2002-166567 | 6/2002 |
| JP | 2003 145791 | 5/2003 |
| JP | 2003 237037 | 8/2003 |
| WO | WO 01/64441 | 3/2001 |

OTHER PUBLICATIONS

Patent Abstracts of Japan, Ito Hirosumi, Appln No. 10-275452 Sep. 29, 1998 (machine translation).

* cited by examiner

INKJET PRINTER HEAD AND INKJET PRINTER

This application is a continuation application of U.S. patent application Ser. No. 11/004,737 filed on Dec. 3, 2004 now U.S. Pat. No. 7,252,369. U.S. patent application Ser. No. 11/004,737 claims priority of and is based on Japanese Patent Applications Nos. 2003-405972 and 2003-405973 filed in Dec. 4, 2003 and No. 2003-424453 filed in Dec. 22, 2003, the contents of which are incorporated hereinto by reference.

BACKGROUND OF THE INVENTION

1. Field of the Invention

The present invention relates to an inkjet printer head equipped with a front head unit and an ink-channel defining unit which are connected to each other, and also an inkjet printer incorporating such an inkjet printer head.

2. Discussion of Related Art

There is known an inkjet printer arranged to perform a printing operation by ejecting ink droplets onto a print media (e.g., paper sheet) through nozzles in accordance with an input signal. Conventionally, such an inkjet printer includes a front head unit incorporating a member which is formed with nozzles, and the member formed with the nozzles provides an outside surface of the front head unit which surface is to be opposed to a print media. For example, U.S. Pat. No. 5,748,214 (corresponding to JP-A-H08-276586) discloses an inkjet printer head including a laminar-structured front head unit which is equipped with: a nozzle plate formed with a multiplicity of nozzles opening in its outside surface and arranged in a plurality of rows; a plurality of ink-channel defining plates defining ink channels; and a piezoelectric actuator capable of pressurizing an ink within each of the ink channels communicating with a corresponding one of the nozzles so that the ink is ejected through the corresponding nozzle. The inkjet printer head further includes an ink-channel defining unit (which is referred to as "head holder" in the U.S. Patent publication) which holds the front head unit and which supplies an ink into the front head unit through ink outlets and ink inlets respectively formed in the ink-channel defining unit and front head unit. The front head unit and the ink-channel defining unit are firmly fixed to each other through an adhesive which is applied onto mutually opposed surfaces thereof, with the ink outlets and inlets being mutually aligned.

Since the mutually aligned ink outlets and inlets open in the above-described mutually opposed surfaces (onto which the adhesive is applied), the adhesive could flow into the ink inlets, thereby possibly impeding supply of the ink from the ink-channel defining unit to the front head unit. The U.S. Patent Publication teaches a technique to prevent the adhesive from flowing into the above-described ink inlets. Specifically described, in the inkjet printer head disclosed in the U.S. Patent Publication, a protrusion is formed on the surface of the ink-channel defining unit so as to surround the openings of the ink outlets, so that the ink is inhibited by the protrusion, from flowing into the ink inlets (see FIG. 14 of the U.S. Patent Publication). The front head unit and the ink-channel defining unit are fixed to each other through the adhesive applied over wide areas of the mutually opposed surfaces except their portions in which the ink outlets and inlets open.

However, it is common that the front head unit and the ink-channel defining unit are made of a metallic material and a synthetic resin, respectively, which are considerably different from each other in coefficient of linear expansion. Therefore, the inkjet printer head is likely to suffer from an ink leakage due to separation of the front head unit and the ink-channel defining unit from each other, which separation could be caused as a result of its long-term service under an environment having temperature fluctuation.

It might be possible to reduce the areas at which the two units are bonded to each other, for preventing the separation of the two units. However, the reduction in the bonded areas leads to a reduction in rigidity of the front head unit, thereby possibly inducing a so-called "cross talk" between the adjacent rows of the nozzles. That is, pressure fluctuation occurred in each row of the nozzles could be propagated to another row of the nozzles, whereby a printing performance of the printer head is likely to be affected.

For preventing the separation of the two units, it might be also possible to interpose an elastic sealing member between the ink outlets of the ink-channel defining unit and the ink inlets of the front head unit. However, since the front head unit is thin as a whole in spite of its metallic laminar structure, the front head unit is likely to be warped or deformed by a reaction force exerted by the elastic sealing member which is compressed between the two units. If the front head unit is thus deformed, directions of the nozzles are problematically changed.

U.S. Pat. No. 6,652,081 (corresponding to JP-A-2003-145791) discloses an inkjet printer head equipped with a sealing system which enables the two units to be fixed to each other without warping or deforming the front head unit. The sealing mechanism includes a sleeve disposed on the ink inlet of the front head unit, an O-ring mounted on the sleeve, and a backup member disposed between the two units, such that the O-ring is pressed by the backup member against the ink-channel defining unit while at the same time being tightly fitted on an outer circumferential surface of the sleeve. In this sealing system, a reaction force exerted by the compressed O-ring acts on the backup member (which is held by a portion of the ink-channel defining unit) rather than on the front head unit (see FIGS. 10A and 10B of the U.S. Patent Publication). However, this sealing system requires the O-ring and the sleeve for the fluid-tight connection between the ink outlet and inlet, and also the backup member for the prevention of deformation of the front head unit, thereby leading to an increased number of required components and an increased number of required steps in its manufacturing process, and consequently resulting in a high cost of manufacture of the inkjet printer head. Further, since an adhesive is used for the disposition of sleeve on the ink inlet of the front head unit, this sealing system is likely to still suffer from the above-described conventionally experienced problem that the supply of the ink from the ink-channel defining unit to the front head unit could be impeded by the adhesive having flowed into the ink inlet.

On the other hand, there is also known an arrangement in which a driver circuit (for driving the front head unit) is mounted on a carriage that is reciprocatable in a primary scanning direction (i.e., direction perpendicular to a direction in which the print media is to be fed). In the inkjet printer having this arrangement, a printing operation is performed by ejecting the ink onto the print media through selected ones of the nozzles in response to a drive signal outputted from the driver circuit to the front head unit. In the printing operation, each time the signal is outputted from the driver circuit to the front head unit, a large amount of electric current momentarily flows through the driver circuit, thereby inducing an abrupt increase in temperature at the driver circuit. Since the number of the nozzles provided in the head unit has been increased for attending a need for printing a higher density of image at a higher speed, the driver circuit has to be equipped with an increased number of driver elements each serving exclusively for a corresponding one of the nozzles. That is, as a result of provision of the increased number of the nozzles, the number of the driver elements provided in the driver circuit has become larger, so that the temperature increase induced at the driver circuit has become more considerable. The considerable temperature increase caused deterioration and instability in electrical properties of the driver circuit, thereby impeding a stable ejection of the ink.

In view of this problem rising from the temperature increase, there has been designed an arrangement, as disclosed in JP-A-2003-237037, in which a heat conductive body is mounted on the carriage so that heat generated at the diver circuit can be dissipated. In the arrangement disclosed in JP-A-2003-237037, the heat conductive body is provided by a plate member which is bent to have a U shape in its cross section, and is fixed relative to the carriage, such that its central bottom portion is held in contact with the driver circuit which is mounted on the carriage, and such that major surfaces of its respective opposite end portions are held in substantially perpendicular to the primary scanning direction (in which the carriage is movable), whereby the generated heat can be effectively dissipated.

Further, there is also known an arrangement, as disclosed in JP-A-2000-103084, in which the ink is supplied to the front head unit mounted on the movable carriage, from an ink tank held stationary in a main body of the inkjet printer, via a flexible tube. However, in this arrangement, air inevitably permeates through the flexible tube and dissolving in the ink within the tube, because of properties of material forming the tube. The air or bubbles contained in the ink may cause failure in the ink ejection and the consequent deterioration in the quality of the printed image. It has been therefore necessary to provide a bubble collector or retainer chamber on an upstream side of the front head unit, for removing the bubbles from the ink.

SUMMARY OF THE INVENTION

The present invention was made in view of the background prior art discussed above. It is therefore a primary object of the invention to provide an inkjet printer head or inkjet printer which is provided with a front head unit having a high degree of rigidity and which is capable of performing a printing operation with a high degree of stability of its ink ejection characteristic, without suffering from an ink leakage or a drawback rising from an adhesive which is used for the provision of the front head unit. It is a secondary object of the invention to provide a small-sized inkjet printer equipped with a small-sized carriage which carries a heat dissipater and a bubble discharger, for effectively dissipating heat generated at a driver circuit of the front head unit and removing bubbles from the ink in the front head unit, so as to prevent failure in the ink ejection. The primary object may be achieved according to any one of first through sixth aspects of the invention which are described below. The secondary object may be achieved according to either the fourth or seventh aspect of the invention which is described below.

The first aspect of the invention provides an inkjet printer head comprising: (a) a front head unit having (a-i) an outside surface which is to be opposed to a print media, (a-ii) an inside surface which is opposite to the outside surface, (a-iii) a plurality of nozzles which open in the outside surface and are arranged in at least one row, and (a-iv) at least one ink inlet which opens in the inside surface; (b) an ink-channel defining unit which supplies an ink into the front head unit through the above-described at least one ink inlet; (c) a head holder which holds the front head unit; and (d) a reinforcement member which is fixed to the inside surface of the front head unit so as to reinforce the front head unit. The front head unit and the head holder are fixed to each other, with the reinforcement member being interposed therebetween. The ink-channel defining unit is fixed to one of opposite side surfaces of the reinforcement member that is remote from the front head unit.

According to the second aspect of the invention, in the inkjet printer head in the first aspect of the invention, the reinforcement member has at least one ink passage hole located in a hole location region thereof corresponding to location of the above-described at least one ink inlet which is formed in the front head unit, such that the ink can be delivered from the ink-channel defining unit into the above-described at least one ink inlet through the above-described at least one ink passage hole. The reinforcement member is fixed, at least in the hole location region in which the above-described at least one ink passage hole is located, to the ink-channel defining unit.

According to the third aspect of the invention, in the inkjet printer head in the second or third aspect of the invention, the reinforcement member is provided by a plate-like member, and the front head unit is covered, at least in a peripheral portion of the inside surface, by the plate-like member reinforcement member.

The fourth aspect of the invention provides an inkjet printer comprising: (a) the inkjet printer head defined in any one of the first through third aspects of the invention; (b) a carriage which carries the inkjet printer head and is reciprocatable in a primary scanning direction; (c) an ink supplier which supplies the ink from an ink storage container toward the nozzles therethrough; (d) a driver circuit which outputs a drive signal for driving the front head unit; (e) a heat dissipater which dissipates heat generated by the driver circuit; (f) a bubble retainer which retains a bubble generated in the ink supplier; and (g) a bubble discharger which discharges the bubble from the bubble retainer. The heat dissipater, the bubble discharger and the front head unit are mounted on the carriage, and are arranged in the primary scanning direction.

The fifth aspect of the invention provides an inkjet printer head comprising: (a) a front head unit having (a-i) an outside surface which is to be opposed to a print media, (a-ii) an inside surface which is opposite to the outside surface, (a-iii) a plurality of nozzles which open in the outside surface and are arranged in at least one row, and (a-iv) at least one ink inlet which opens in the inside surface; (b) an ink-channel defining unit which supplies an ink into the front head unit through the above-described at least one ink inlet; and (c) a head holder which holds the front head unit. The front head unit is provided by a plate-like unit such that a dimension thereof as measured in a direction perpendicular to the outside surface thereof is smaller than a dimension thereof as measured in a direction parallel with the outside surface thereof. The head holder has a parallel wall which is substantially parallel with the plate-like front head unit and which has an aperture formed in a portion thereof opposed to the above-described at least one ink inlet of the front head unit. The front head unit is fixed at the inside surface thereof to the parallel wall of the head holder. The ink-channel defining unit is located in one of opposite sides of the parallel wall of the head holder that is remote from the front head unit, and has at least one ink outlet which is held in communication with the above-described at least one ink inlet through the aperture of the parallel wall. The ink-channel defining unit is fixed, at least in a plurality of portions thereof which are spaced apart from each other in the direction parallel with the outside surface of the front head unit, to the front head unit by fasteners.

The sixth aspect of the invention provides an inkjet printer head comprising: (a) a front head unit having (a-i) an outside surface which is to be opposed to a print media, (a-ii) an inside surface which is opposite to the outside surface, (a-iii) a plurality of nozzles which open in the outside surface and are arranged in at least one row, and (a-iv) at least one ink inlet which opens in the inside surface; (b) an ink-channel defining unit which supplies an ink into the front head unit through the above-described at least one ink inlet; and (c) a reinforcement member which is provided by a frame-like member disposed on the inside surface of the front head unit. The front head unit and the ink-channel defining unit are fixed to each other, with the reinforcement member being interposed therebetween. The reinforcement member has at least one ink passage hole located in a hole location region thereof corresponding to location of the above-described at least one ink inlet which is formed in the front head unit, such that the ink can be delivered from the ink-channel defining unit into the above-described at least one ink inlet through the above-described at least one ink passage hole.

The seventh aspect of the invention provides an inkjet printer comprising: (a) a front head unit having (a-i) an outside surface which is to be opposed to a print media, and (a-ii) a plurality of nozzles which open in the outside surface; (b) a carriage which carries the front head unit and is reciprocatable in a primary scanning direction; (c) an ink supplier which supplies the ink from an ink storage container toward the nozzles therethrough; (d) a driver circuit which outputs a drive signal for driving the front head unit; (e) a heat dissipater which dissipates heat generated by the driver circuit; (f) a bubble retainer which retains a bubble generated in the ink supplier; and (g) a bubble discharger which discharges the bubble from the bubble retainer. The heat dissipater, the bubble discharger and the front head unit are mounted on the carriage, and are arranged in the primary scanning direction.

In the inkjet printer head or inkjet printer constructed according to any one of the first through fourth and sixth aspects of the invention, the front head unit is fixed in its inside surface to the reinforcement member which is in turn fixed to the ink-channel defining unit, whereby the front head unit is integrated with the reinforcement member and the ink-channel defining unit, and is given an increased rigidity. Owing to the increased rigidity, it is possible to effectively restrain deformation of the front head unit and occurrence of "cross talk" between the adjacent rows of the nozzles. It is noted that the reinforcement member is preferably made of a metallic material, so that the front head unit can be further reinforced or given a further increased rigidity.

In the inkjet printer head according to the second aspect of the invention, the reinforcement member is fixed, at least in the hole location region in which the ink passage hole or holes are located, to the ink-channel defining unit. That is, where the ink inlet or inlets and the ink passage hole or holes are located in end portions of the respective front head unit and reinforcement member, for example, it is possible to establish an ink delivery channel or channels between the ink-channel defining unit and the reinforcement member, by simply fixing the ink-channel defining unit and the reinforcement member only at least in their end portions. In other words, the ink-channel defining unit and the reinforcement member do not have to be fixed in their larger number of portions. The fixing of the ink-channel defining unit and the reinforcement member in their minimized number of portions is effective to save the number of components and the number of steps in a process of manufacturing the inkjet printer head.

In the inkjet printer head according to the third aspect of the invention in which the front head unit is covered, at least in the peripheral portion of the inside surface, by the plate-like member reinforcement member, the front head unit is supported substantially in entirety of its surface by the reinforcement member. In this arrangement, the front head unit is reinforced, particularly, against a force acting thereon in a direction perpendicular to its inside surface, so as to be prevented from being deformed by such a perpendicularly acting force. This advantage is significant particularly where the front head unit is provided by a plate-like unit such that the above-described inside surface is provided by a major surface of the plate-like front head unit.

In the inkjet printer head according to the fifth aspect of the invention, the front head unit is fixed at its inside surface to the parallel wall of the head holder, and is accordingly given an increased rigidity, thereby making it possible to effectively restrain deformation of the front head unit and occurrence of "cross talk" between the adjacent rows of the nozzles. Further, since the front head unit is firmly fixed to the ink-channel defining unit by the fasteners, the positional relationship between the front head unit and the ink-channel defining unit is not considerably affected, even in a case where the front head unit and the head holder are provided by respective materials which are considerably different from each other in coefficient of linear expansion and are fixed to each other by an adhesive. That is, this arrangement is effective to avoid an ink leakage or other drawbacks rising from a temperature fluctuation. Still further, since the ink outlet or outlets of the ink-channel defining unit and the ink inlet or inlets of the front head unit are connected to each other through the aperture of the parallel wall of the head holder, namely, since the connection between the ink outlets and inlets is established without interference of the head holder thereto, the printer head is free from an ink leakage even in the event of separation of the head holder and the front head unit from each other.

In the inkjet printer head according to the sixth aspect of the invention, the front head unit is fixed to the ink-channel defining unit, with the reinforcement member having the ink passage hole or holes being interposed therebetween. Therefore, even where the front head unit is so tightly fastened to the ink-channel defining unit that a reaction force is exerted by the ink-channel defining unit (or an elastic sealing member if it is interposed therebetween), such a reaction force is received by the reinforcement member rather than by the front head unit. Thus, the front head unit does not suffer from its deformation.

In the inkjet printer according to the fourth or seventh aspect of the invention, the heat generated by the driver circuit is effectively dissipated by the heat dissipater, while the bubble generated in the ink supplier is discharged by the bubble discharger without allowing the bubble to be introduced into the front head unit. That is, characteristics of the driver circuit can be stabilized owing to the heat dissipater, while ink ejection characteristics of the nozzles can be stabilized owing to the bubble discharger. The feature of this the inkjet printer lies in its arrangement in which the heat dissipater, the bubble discharger and the front head unit are arranged in the primary scanning direction, i.e., in a direction in which the carriage is to be reciprocated during a printing operation. In other words, in this arrangement, the heat dissipater, the bubble discharger and the front head unit are arranged in a direction in which a space (required for allowing the reciprocating motion of the carriage) is elongated, thereby eliminating a need of providing another space exclusively serving for the dispositions of the heat dissipater and the bubble discharger. Further, owing to this arrangement, the carriage can be made small in its dimension as measured in a secondary scanning direction that is perpendicular to the primary scanning direction, whereby the inkjet printer in its entirety can be made compact.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENT

Figure 1:
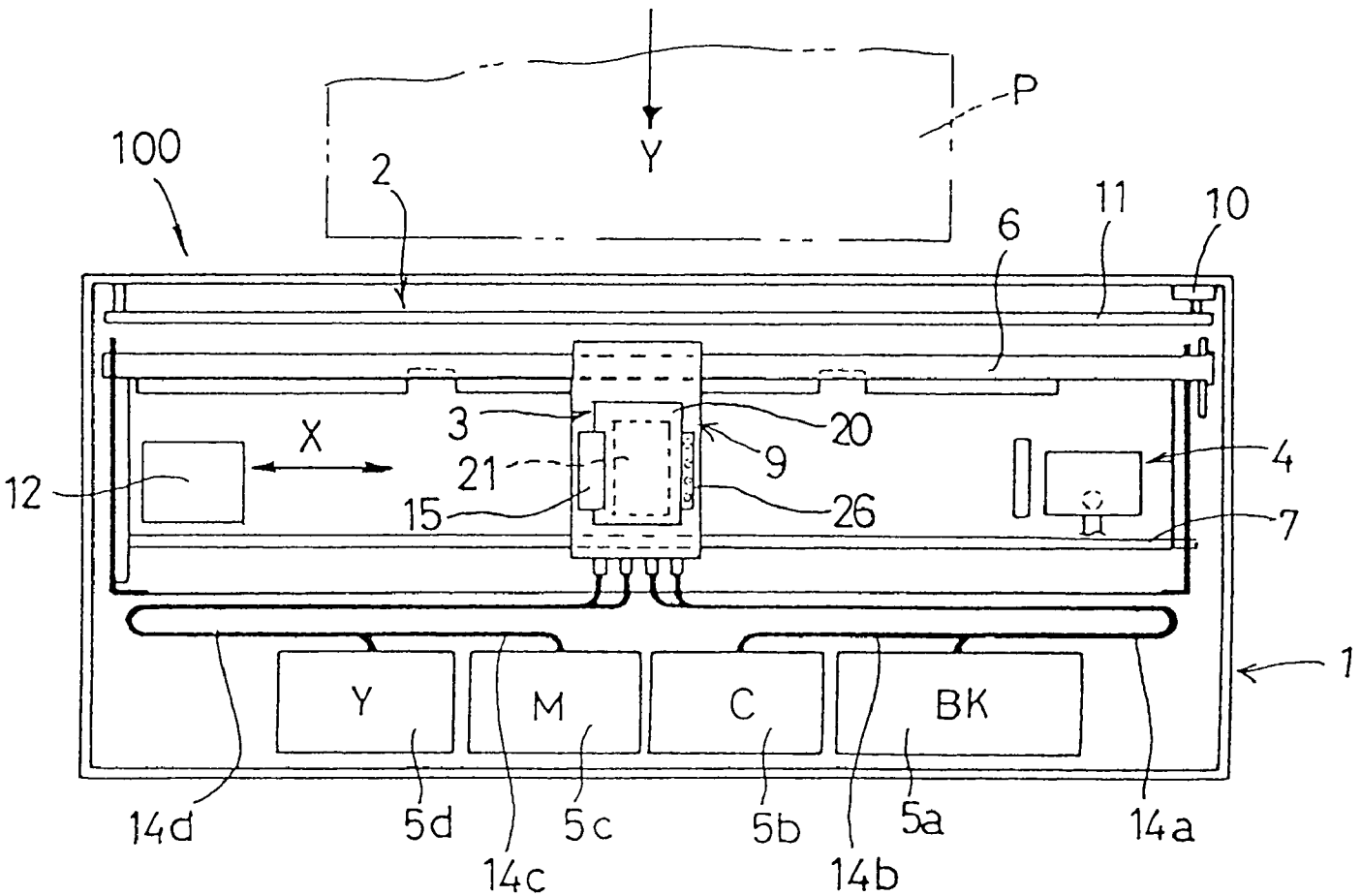
FIG. 1 is a top-plan view of an inkjet printer constructed according to an embodiment of the invention.

There will be described a preferred embodiment of the present invention by reference to the accompanying drawings. FIG. 1 is a top-plan view of an inkjet printer 100 constructed according to an embodiment of the invention. This inkjet printer 100 includes a housing 1; a recording portion 2 incorporated in the housing 1; a recorder or printer head 3 included in the recording portion 2 and operable to eject ink droplets toward a paper sheet P as a print media so as to record or print an image thereon; a maintenance unit 4 operable to maintain upkeep of the printer head 3; and four ink tanks 5 detachably fixed within the housing 1 and storing respective different colors of inks that are to be supplied to the printer head 3.

The four ink tanks 5*a*, 5*b*, 5*c*, 5*d*, which are provided for a full-color printing operation, store a black ink (BK), a cyan ink (C), a yellow ink (Y), and a magenta ink (M), respectively. Each of the ink tanks 5 is replaceable with a new one, as the stored ink has been consumed.

In the recording portion 2, mutually parallel front and rear guides in the form of a guide way 7 and a guide rod 6 are provided to extend in a longitudinal direction of the housing 1. The guide way 7 and the guide rod 6 cooperate with each other to guide a carriage 9 which is mounted thereon slidably in a primary scanning direction (i.e., in a direction indicated by arrow "X" in FIG. 1). The carriage 9 carries the printer head 3 attached thereto.

A carriage drive motor 10 is disposed in a rear right portion of the housing 1, and cooperates with an endless timing belt 11 to reciprocate the carriage 9 along the guide rod 6 and the guide way 7 in the primary scanning direction, i.e., in the longitudinal direction of the housing 1. Meanwhile, a known feed mechanism (not shown) is provided to feed the paper sheet P in a secondary scanning direction (i.e., in a direction indicated by arrow "Y" in FIG. 1) perpendicular to the primary scanning direction, such that the paper sheet P passes below a lower or outside surface of the printer head 3 while taking its horizontal posture.

An ink receiver unit 12 is also provided within the housing 1, such that the ink receiver unit 12 is located on one of widthwise opposite sides of the fed paper sheet P (i.e., on the left end portion of the housing 1 as seen in FIG. 1) while the maintenance unit 4 is located on the other of the widthwise opposite sides of the paper sheet P. During a printing operation carried out by the inkjet printer 100, the printer head 3 is periodically moved to be positioned in an ink flushing position, and is commanded to eject a certain amount of ink so as to prevent clogging of nozzles 22 (see FIG. 2) which open in the outside surface of the printer head 3. In this instance, the ejected ink is received by the ink receiver unit 12 which is located in the ink flushing position. When the printer head 3 is positioned in its home position, the printer head 3 is subjected to a cleaning treatment, as needed, in which the nozzle opening or outside surface of the printer head 3 is cleaned by the maintenance unit 4 located in the home position. While being positioned in the home position, the printer head 3 is further subjected to a recovery treatment and a bubble removal treatment, as needed, both of which are made by the maintenance unit 4, too. In the recovery treatment, a selected one or ones of the four color inks are sucked by the maintenance unit 4. In the bubble removal treatment, bubbles (i.e., air) collected or retained by a damper unit 13 of the printer head 3 are removed therefrom by the maintenance unit 4.

The four ink tanks 5 can be disposed, independently of each other, in their respective positions within the housing 1 which are located below the nozzle opening or outside surface of the printer head 3, for example, by introducing them into respective four tank holders in a direction away from the front side toward the rear side of the housing 1. The black ink (BK) tank 5*a*, the cyan ink (C) tank 5*b*, the magenta ink (M) tank 5*c* and the yellow ink (Y) tank 5*d* are arranged in a horizontal row in this order of description, as viewed in the leftward direction as seen in FIG. 1. It is noted that the four ink tanks 5*a*-5*d* are connected in parallel with each other, to respective ink channels.

Each of the four tank holders has an ink supply hollow needle (not shown) which projects horizontally from a rear wall thereof in the frontward direction opposite to the direction in which the corresponding ink tank 5 is introduced into the tank holder. The ink supply hollow needles are connected at their respective proximal ends to the printer head 3 via respective ink supply tubes 14*a*-14*d* each having a high degree of flexibility. In this arrangement, the black ink supply tube 14*a* and the cyan ink supply tube 14*a* are superposed at their respective intermediate portions on each other, while the magenta ink supply tube 14*c* and the yellow ink supply tube 14*d* are superposed at their respective intermediate portions on each other, as shown in FIG. 1. It is noted that each of the ink supply tubes 14 serves as an ink supplier for supplying the ink from the corresponding ink tank 5 as an ink storage container toward the nozzles 22 therethrough.

Figure 2:
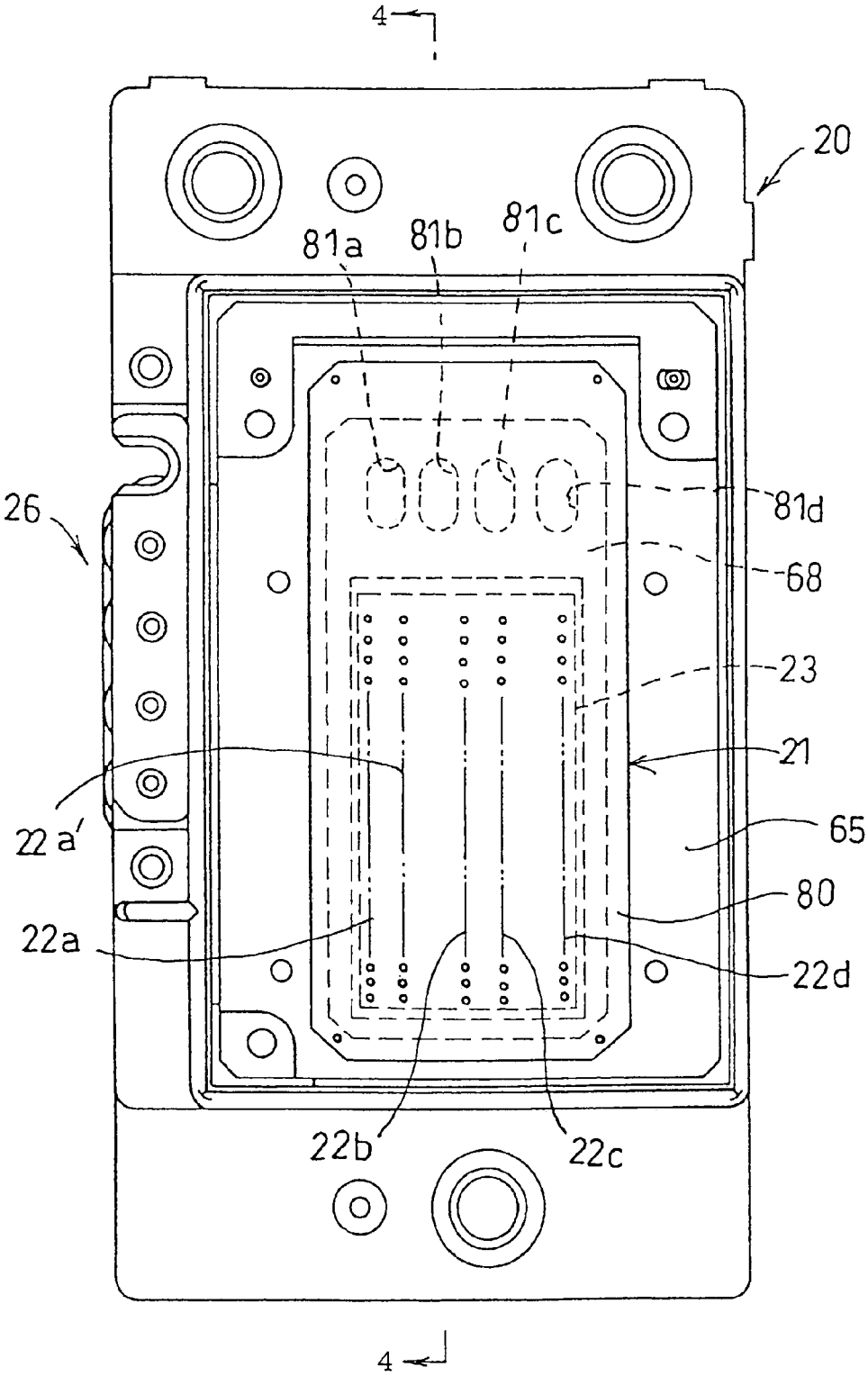
FIG. 2 is a bottom-plan view of a printer head of the inkjet printer of FIG. 1.
Figure 3:
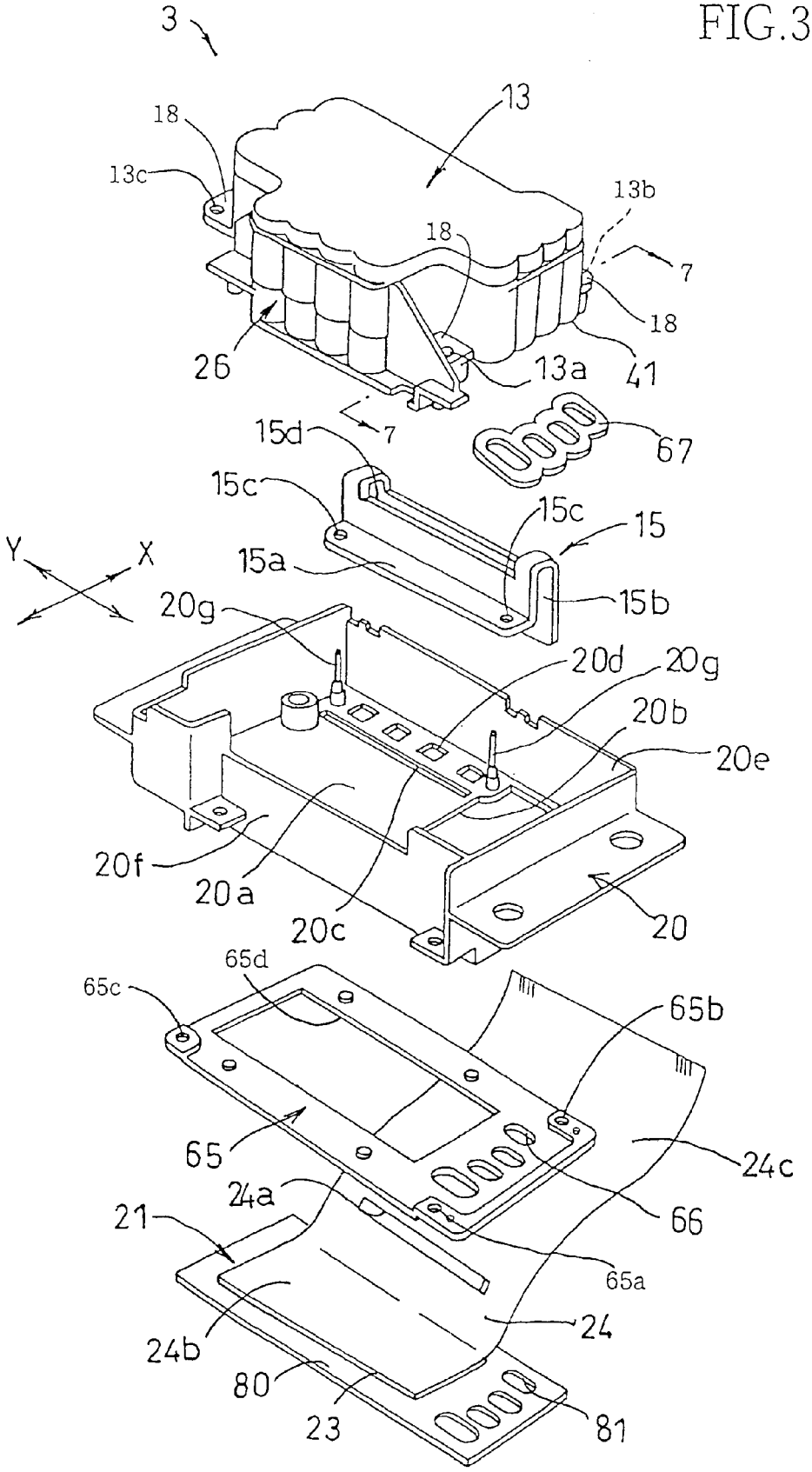
FIG. 3 is a perspective and exploded view of the printer head of FIG. 2.
Figure 4:
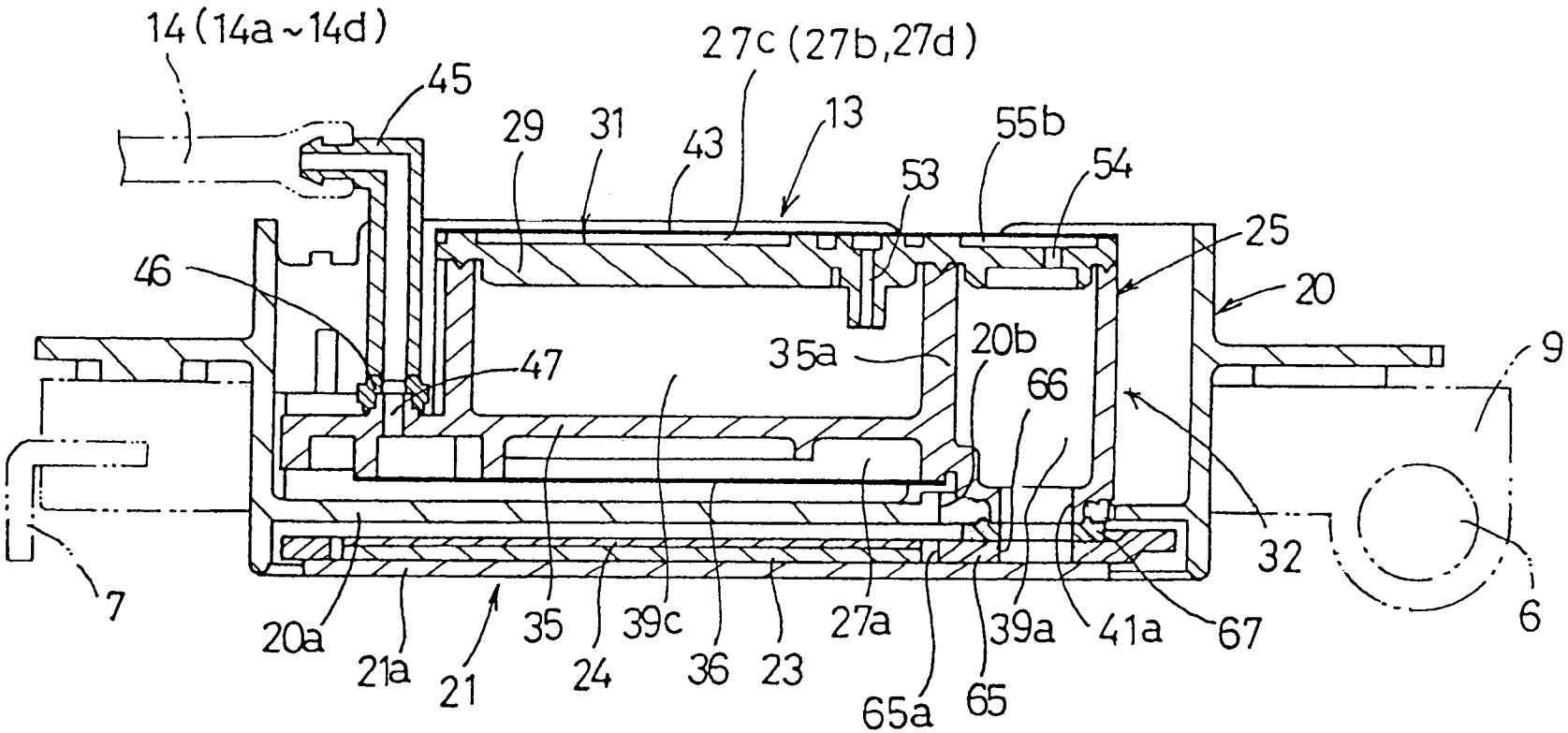
FIG. 4 is a cross sectional view taken along line 4-4 in FIG. 2.

Next, the printer head 3 mounted on the carriage 9 will be described in detail by reference to FIGS. 2-8. In the present embodiment, the printer head 3, which is designed to perform a full color printing operation, includes: the above-described damper unit 13 as an ink-channel defining unit; a head holder 20 which is connected directly to the carriage 9 (see FIG. 4); a front head unit 21 which has an outside surface corresponding to the above-described nozzle opening or outside surface defining the openings of the nozzles 22; a driver circuit 24*a* which is operable to output a drive signal for driving the front head unit 21; a heat sink or dissipater 15 which dissipates heat generated by the driver circuit 24*a*; and a bubble discharger 26 which is operable to discharge the bubbles collected or retained by the damper unit 13, as shown in FIGS. 3 and 4. The front head unit 21 is provided by a plate-like unit, such that its dimension as measured in a direction perpendicular to its outside surface is smaller than its dimension as measured in a direction parallel with its outside surface. The head holder 20 is provided by a box-like member made of a synthetic resin, and has a bottom wall 20*a* as a parallel wall which is held in substantially parallel with an inside surface of the front head unit 21. The front head unit 21 is fixedly positioned on the lower side of the bottom wall 20*a* of the head holder 20, while the damper unit 13, the heat dissipater 15 and the bubble discharger 26 are fixedly positioned on the upper side of the bottom wall 20*a* of the head holder 20. Further, as is apparent from FIGS. 1 and 13, the heat dissipater 15, the bubble discharger 26 and the front head unit 21 are mounted on the carriage 9, so as to be arranged in the primary scanning direction (i.e, in the X-axis direction).

The carriage 9 is provided by a frame-like member having an aperture in its central portion, so that the box-like head holder 20 opening upwardly is received in the aperture of the carriage 9, as shown in FIG. 4. The head holder 20 is fixed to the carriage 9 through screw bolts (not shown) provided in its end portions which are opposite to each other as viewed in Y-axis direction (i.e., in the secondary scanning direction). The head holder 20 has opposite side walls 20*e*, 20*f* as its two side portions, which are opposite to each other as viewed in the X-axis direction (see FIG. 4). The front head unit 21 is located between the opposite side walls 20*e*, 20*f* The heat dissipater 15 is located in the vicinity of one 20*e* of the opposite side walls 20*e*, 20*f*, while the bubble discharger 26 is located in the vicinity of the other side wall 20*f*.

Figure 13:
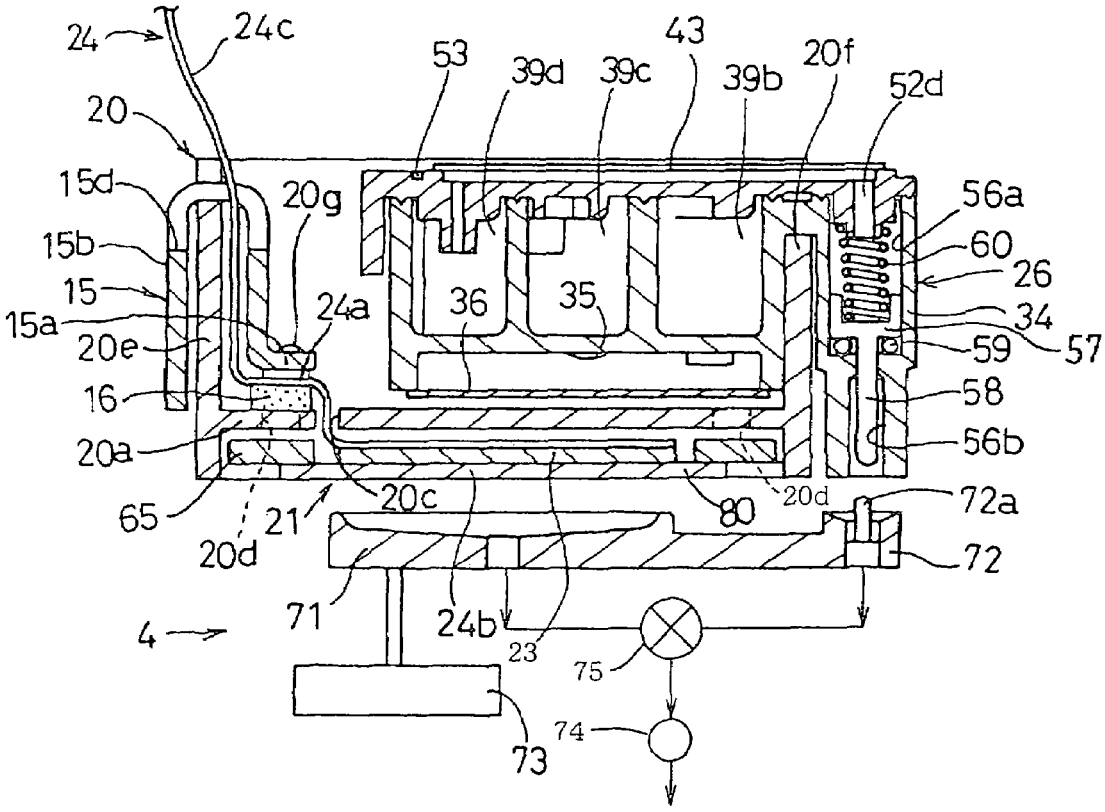
FIG. 13 is a cross sectional view taken along line 13-13 in FIG. 9.

The front head unit 21 is constituted principally by a cavity unit 80 and a piezoelectric actuator 23 which is disposed on an upper surface of the cavity unit 80. On an upper surface of the piezoelectric actuator 23, a flexible flat cable 24 is disposed so that a drive voltage can be applied to the piezoelectric actuator 23 through the flat cable 24. The flat cable 24 includes an end portion 24*b* serving as its fixed portion at which the flat cable 24 is fixed to the piezoelectric actuator 23. The flat cable 24 further includes a flexible portion 24*c* which has a high degree of flexibility and extends upwardly form the upper surface of the piezoelectric actuator 23, as shown in FIG. 13. The above-described driver circuit 24*a* in the form of an integrated circuit chip is disposed on this flexible portion 24*c* of the flat cable 24. The flat cable 24 is removably connected at another end portion thereof to another flexible flat cable (not shown), in a known manner, which extends from a controller board (not shown) held stationary within the housing 1.

Figure 5:
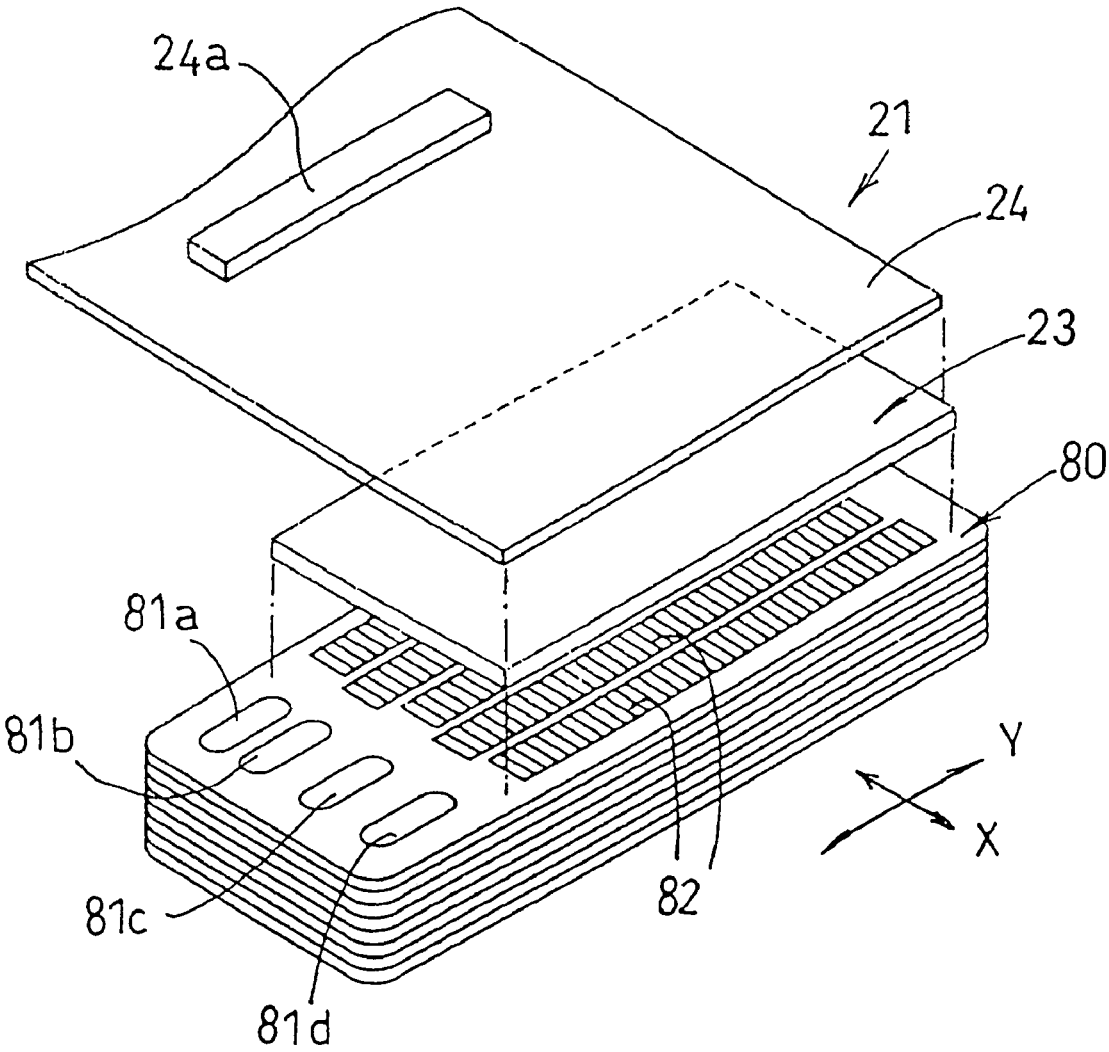
FIG. 5 is a perspective view of a front head unit of the printer head of FIG. 2.

The front head unit 21 has four ink inlets 81 located in one of its end portions which are opposite to each other as viewed in the Y-axis direction, as shown in FIGS. 3 and 5. The four ink inlets 81 open in the upper or inside surface of the front head unit 21 (i.e., in the upper or inside surface of the cavity unit 80) such that the four color inks can be supplied into the cavity unit 80 from the ink tanks 5, through the damper unit 13 and the respective four ink inlets 81. In the present embodiment, the piezoelectric actuator 23 has an outer contour which is smaller than that of the cavity unit 80, so that the ink inlets 81 and an peripheral portion of the inside surface of the cavity unit 80 are not covered with the piezoelectric actuator 23 and the flat cable 24 which are disposed on the inside surface of the cavity unit 80.

The printer head 3 further includes a reinforcement member 65 which is disposed on the inside surface of the front head unit 21, such that the front head unit 21 is fixed relative to the damper unit 13 and the head holder 20, with the reinforcement member 65 being interposed therebetween, as shown in FIGS. 3 and 4. The front head unit 21 is disposed on one of opposite sides of the reinforcement member 65, while the damper unit 13 and the head holder 20 are disposed on the other of the opposite sides of the reinforcement member 65. The reinforcement member 65 is provided by a frame-like body having an aperture 65*d* formed through a central portion thereof. The aperture 65*d* of the reinforcement member 65 is slightly larger than the outer contour of the piezoelectric actuator 23, and is smaller than the outer contour of the cavity unit 80, so that the piezoelectric actuator 23 and the fixed portion 24*b* of the flat cable 24 (which are disposed on the inside surface of the cavity unit 80) are surrounded by an inner circumferential surface of the frame-like reinforcement member 65 which defines the aperture 65*d*.

In the bottom wall 20*a* of the head holder 20, there are formed an aperture 20*b*, a slit 20*c* and a plurality of through-holes 20*d*, as shown in FIG. 3. The aperture 20*b* is located in one of end portions which are opposite to each other in the Y-axis direction. The slit 20*c* is located in the vicinity of the side wall 20*e* so as to be elongated in the Y-axis direction. The through-holes 20*d* are arranged in two rows (one of which is not shown in FIG. 3) which extend along inside surfaces of the respective side walls 20*e*, 20*f* Further, the head holder 20 has a pair of projections 20*g* located between the slit 20*c* and the side wall 20*e* and projecting upwardly from the bottom wall 20*a*.

Figure 7:
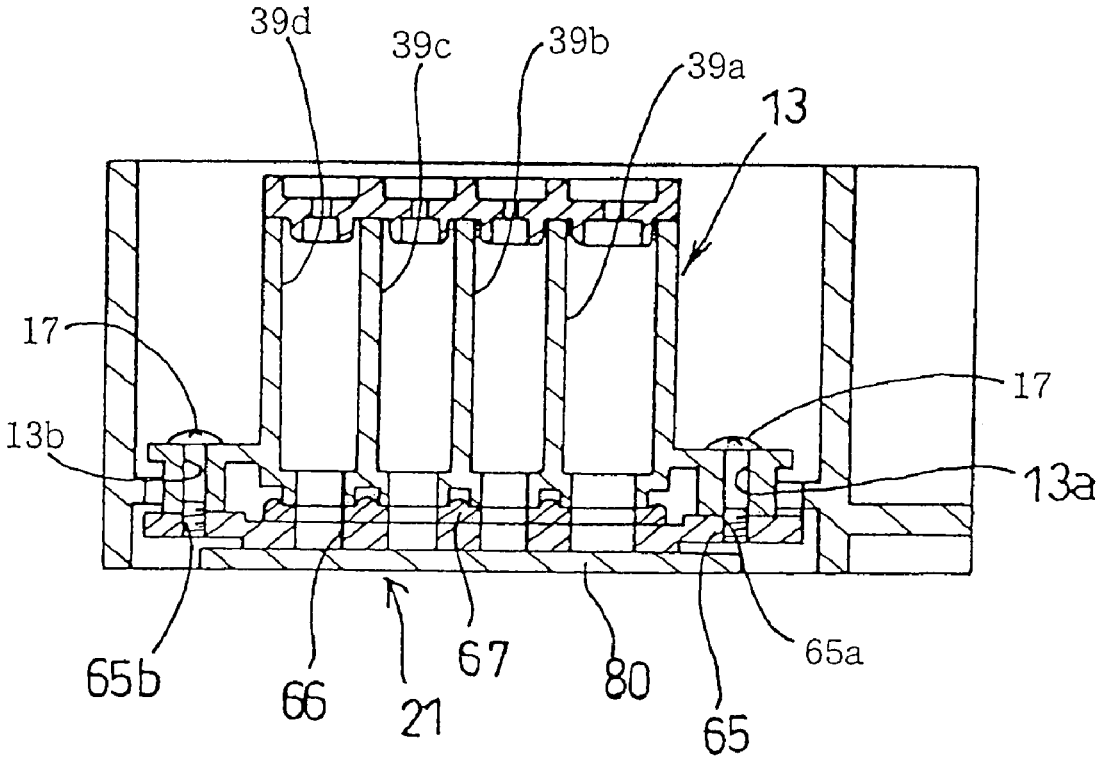
FIG. 7 is a cross sectional view taken along line 7-7 in FIG. 3.

The damper unit 13 is connected, through the aperture 20*b* of the bottom wall 20*a*, to the reinforcement member 65 which adheres to the front head unit 21, as shown in FIGS. 4 and 7. The above-described slit 20*c* is formed through the bottom wall 20*a*, for permitting the flexible flat cable 24 to extend upwardly from the piezoelectric actuator 23 therethrough. The plurality of through-holes 20*d* are formed through the bottom wall 20*a*, so as to serve as an adhesive inlet through which an adhesive can be applied for securing the bottom wall 20*a* to the reinforcement member 65 and the front head unit 21.

The heat dissipater 15 has a contact portion 15*a* which is held in contact with the driver circuit 24*a*, and an exposed portion 15*b* which is contiguous to the contact portion 15*a*. The exposed portion 15*b* is located on the outside of the side wall 20*e* of the head holder 20, namely, is located outwardly of the head holder 20 as viewed in the primary scanning direction (i.e., in the X direction), as shown in FIGS. 3 and 13.

The heat dissipater 15 is provided by a plate member which is made of aluminum or other metallic material and which is bent so as to have a generally inverted U shape in its cross section (see FIG. 13). The metallic plate providing the heat dissipater 15 is bent about a line parallel with its major surfaces (i.e., opposite surfaces opposite to each other in its thickness direction and each having a relatively large width), and has an outside portion which extends along an outside surface of the side wall 20*e* so as to serve as the exposed portion 15*b*, and an inside portion which extends along an inside surface of the side wall 20*e*. The inside portion of the heat dissipater 15 includes an end portion which serves as the above-described contact portion 15*a* and which is bent to be held in parallel with the bottom wall 20*a* of the head holder 20. The heat dissipater 15 further has a cutout 15*d* which is formed between the above-described inside and outside portions so as to be elongated in the Y-axis direction. This cutout 15*d* is located above an upper end of the side wall 20*e*, and permits the flexible portion 24*a* of the flat cable 24 to extend therethrough upwardly from the piezoelectric actuator 23, as shown in FIG. 13.

The heat dissipater 15 still further has a pair of through-holes 15*c* formed in end portions of the contact portion 15*a* which are opposite to each other in the Y-axis direction (see FIG. 13). Each of the above-described projections 20*g* of the head holder 20 passes through a corresponding one of the through-holes 15*c* of the heat dissipater 15, and has an upper end portion which is heat-fused to have an increased diameter (see FIG. 13) for inhibiting removal of the heat dissipater 15 from the head holder 20. An elastic member 16 such as a rubber member is interposed between the driver circuit 24*a* and the bottom wall 20*a* of the head holder 20, and is compressed therebetween. Owing to an elastic force of the elastic member 16, the driver circuit 24*a* is held in close contact with the contact portion 15*a* of the heat dissipater 15.

The generally inverted U-shaped heat dissipater 15, which is provided by the metallic plate bent about the line parallel with its major surface, is fixed relative to the head holder 20, as described above, such that the its major surface of the exposed portion 15*b* is held substantially in perpendicular to the primary scanning direction (i.e., the X-axis direction).

The reinforcement member 65 has four ink passage holes 66 located in its hole location region aligned with or corresponding to location of the above-described four ink inlets 81 of the cavity unit 80, as shown in FIG. 3, so that the ink inlets 81 and the ink outlets 41 of the damper unit 13 are connected to each other through the ink passage holes 66. The frame-like reinforcement member 65 is made of a metallic material (e.g., SUS430), and has a thickness larger than that of the cavity unit 80 so as to be given a high degree of rigidity. The reinforcement member 65 is bonded to the front head unit 21, and contributes to prevent deformation of the front head unit 21.

Figure 8:
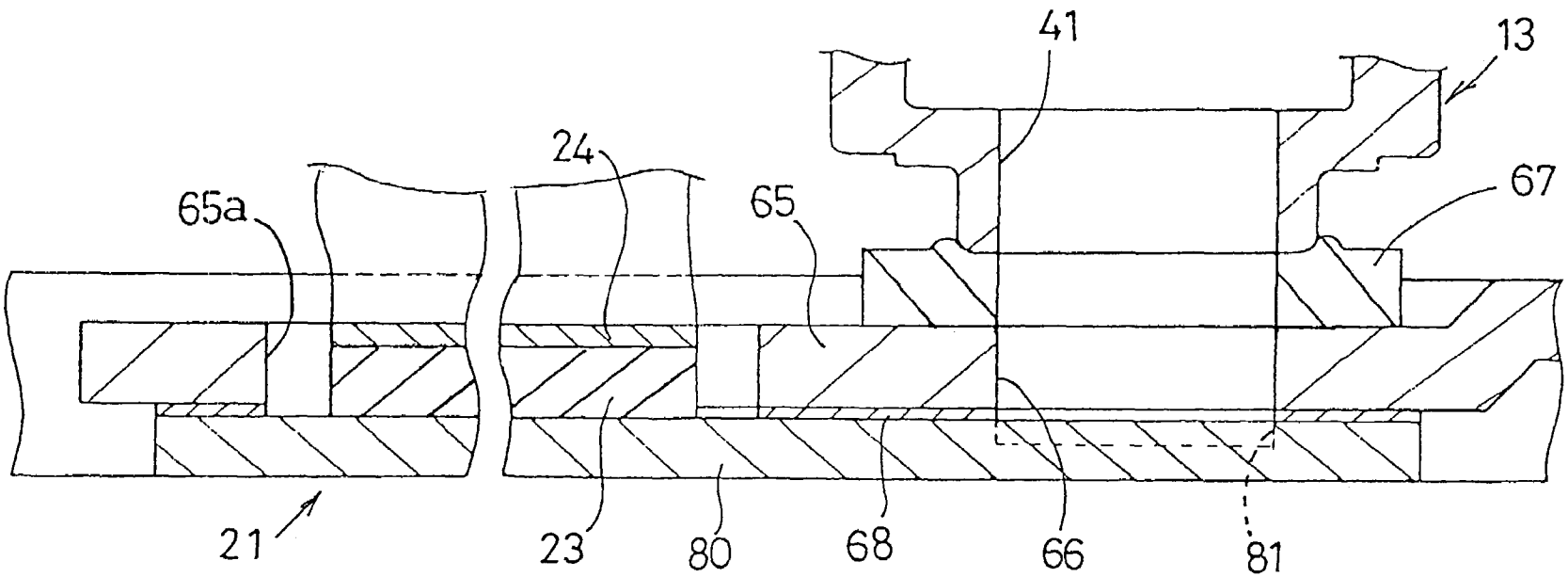
FIG. 8 is a cross sectional view of a part of the printer head of FIG. 2, showing a position of an adhesive sheet which is provided for bonding a damper unit to the front head unit of FIG. 5.

Between the damper unit 13 and the reinforcement member 65, there is disposed an elastic sealing member 67, as shown in FIGS. 3 and 8. This elastic sealing member 67 surrounds the ink passage holes 66, and is compressed between the damper unit 13 are reinforcement member 65 which are well secured to each other by fasteners in the form of three screws 17 (see FIG. 7), whereby each of the ink passage holes 66 is fluid-tightly connected to the corresponding ink outlet 41. The three screws 17 pass through respective through-hoes 13*a*-13*c* formed through respective three fastener receiving portions 18 of the damper unit 13 which are provided by horizontally-outwardly-projecting, flange-like portions of the damper unit 13, and are screwed into respective three internal threaded or tapped holes 65*a*-65*c* formed through the reinforcement member 65. Two 65*a*, 65*b* of the three tapped holes 65*a*-65*c* are positioned on opposite sides of the four ink passage holes 66 which are located in an end portion of the reinforcement member 65 and which are arranged in a row, while another one 65*c* of the three tapped holes 65*a*-65*c* is positioned in the other end portion of the reinforcement member 65. The fluid-tight connections of the ink passage holes 66 and the ink outlets 41 can be established by two of the three screws 17 which are screwed into the above-described two tapped holes 65*a*, 65*b* for contributing to compress the elastic sealing member 67, even without another one of the three screws 17 that is to be screwed into the above-described another one tapped hole 65*c*. In this sense, the tapped hole 65*c* which does not particularly contribute to compress the elastic sealing member 67 is not essential. The tapped hole 65*c* does not have to be provided necessarily in the above-described other end portion of the reinforcement member 65, but may be provided in any other portion of the member 65. The tapped hole 65*c* may be replaced with a plurality of tapped holes provided in any desired portions of the member 65.

The reinforcement member 65 and the front head unit 21 are bonded to each other by a sheet-like adhesive or adhesive sheet 68 which is interposed therebetween. As shown in FIGS. 2 and 8, the adhesive sheet 68 is shaped to continuously surround the piezoelectric actuator 23 and also surround each of the ink inlets 81*a*-81*d*.

The adhesive sheet 68 may be provided by any one of various types of adhesive. However, in the present embodiment, the adhesive sheet 68 is provided by a thermosetting adhesive which contains polyethylene resin as its basis material and which has a high degree of resistance to the ink. The adhesive sheet 68 preferably has, as its own properties, a Youngs modulus of 1-1000 MPa and a melting point of 80-180° C., and is capable of bonding the front head unit 21 and the reinforcement member 65 to each other with a bonding strength of at least 10 N (more preferably at least 200 N). Further, it is preferable that the adhesive sheet 68 is given a thickness of 5-100 μm as measured after it has been cured, namely, after the front head unit 21 and the reinforcement member 65 have been bonded to each other.

Next, the front head unit 21 will be described in detail. In the present embodiment, the multiplicity of nozzles 22 consist of nozzles 22*a*, 22*a*' arranged in two rows assigned to the black ink (BK), nozzles 22*b* arranged in a row assigned to the cyan ink (C), nozzles 22*c* arranged in a row assigned to the yellow ink (Y), and nozzles 22*d* arranged in a row assigned to the magenta ink (M). The two rows of the nozzles 22*a*, 22*a*', the row of the nozzles 22*b*, the row of the nozzles 22*c* and the row of the nozzles 22*d* are arranged in this order of description as viewed from left to right in FIG. 2, and all extend in a direction perpendicular to the primary scanning direction (i.e., in the Y-axis direction). All the nozzles 22 open in the nozzle opening or outside surface of the front head unit 21 that is to be opposed to an upper surface of the paper sheet P.

The four color inks are supplied into the front head unit 21 through the respective ink inlets 81*a*-81*d* which open in the upper surface of the front head unit 21, and each of the four color inks is distributed among the nozzles 22 of the corresponding row or rows through a corresponding ink channel or channels which extend from the corresponding ink inlet 81. The ink droplets are ejected through selected ones of the nozzles 22, by the piezoelectric actuator 23 which is driven by the driver circuit 24*a* in accordance with the signal applied thereto.

Figure 6:
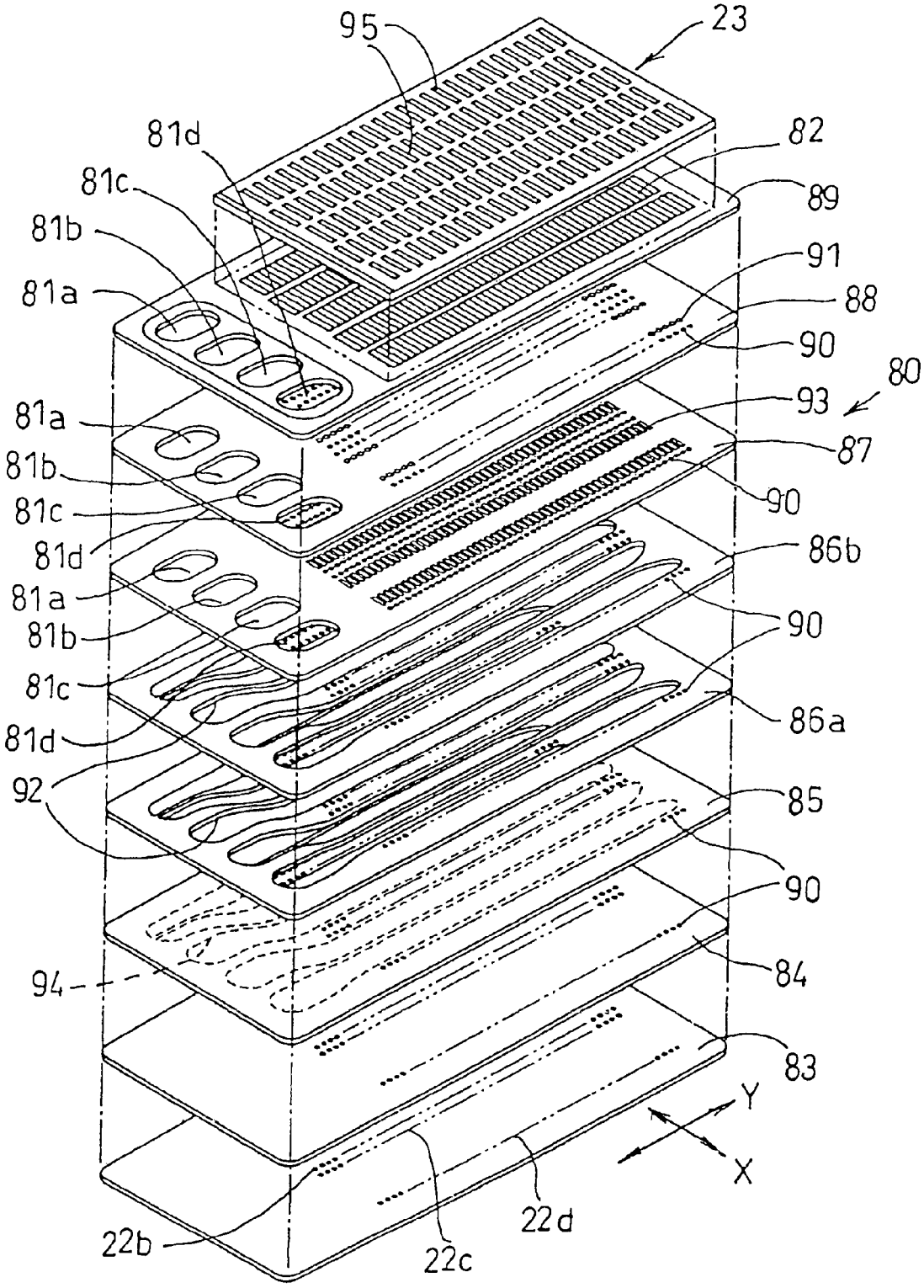
FIG. 6 is a perspective and exploded view of a cavity unit of the front head unit of FIG. 5.

The cavity unit 80 of the front head unit 21 is laminar structure, as shown in FIG. 6, including a nozzle plate 83, a first spacer plate 84, an auxiliary plate 85, two manifold plates 86*a*, 86*b*, a second spacer plate 87, a third spacer plate 88 and a base plate 89. The eight plates 83-89 are provided by respective thin plates, and are fixed to each other by an adhesive.

In the present embodiment, the nozzle plate 83 is formed of a synthetic resin, while the other plates 84-89 are formed of a steel alloy including 42% of nickel and have thickness values of about 50-150 μm. The nozzle plate 83 has the above-described multiplicity of nozzles 22 formed therethrough. The nozzles 22 each having an extremely small diameter (about 25 μm in the embodiment) are arranged in the above-described five rows extending in a longitudinal direction of the nozzle plate 83 (i.e., in the Y-axis direction), such that the nozzles 22 of each adjacent pair of the rows are arranged in a zigzag pattern.

The base plate 89 has a multiplicity of pressure chambers 82 formed therein. The pressure chambers 82 are arranged in five rows extending in a longitudinal direction of the base plate 89 (i.e., in the Y-axis direction), such that the pressure chambers 82 of each adjacent pair of the rows are arranged in a zigzag pattern. Each of the plates 84-88 (i.e., the first spacer plate 84, auxiliary plate 85, two manifold plates 86*a*, 86*b*, second spacer plate 87 and third spacer plate 88) has a multiplicity of through-holes 90 each having an extremely small diameter. Like the nozzles 24 and the pressure chambers 82, the through-holes 90 are arranged in a zigzag pattern. The pressure chambers 82 are held in communication at their respective end portions with the respective nozzles 22 of the nozzle plate 83, via the through-holes 90.

The third spacer plate 88, which is held in contact with a lower surface of the base plate 89, has ink passages in the form of communication holes 91 formed therethrough to be positioned in respective positions corresponding to the other end portions of the respective pressure chambers 82. The communication holes 91 are thus connected to the other end portions of the respective pressure chambers 82.

The second spacer plate 87, which is held in contact with a lower surface of the third spacer plate 88, defines connection passages 93 through which the ink is supplied from common chambers (manifold chambers) 92 to the respective pressure chambers 82.

The two manifold plates 86*a*, 86*b* cooperate to define five common chambers 92 which are formed through the entire thickness of each of the two manifold plates 86*a*, 86*b*. The five common chambers 92 are elongated in the Y-axis direction, so as to extend along the respective five rows of the nozzles 22 which also extend in the Y-axis direction. The five common chambers 92 are defined by the two manifold plates 86*a*, 86*b* superposed on each other, the second spacer plate 87 superposed on an upper surface of the manifold plate 86*b*, and the auxiliary plate 85 underlying a lower surface of the manifold plate 86*a*. Each of the common chambers 92 is elongated in a direction substantially parallel with the rows of the pressure chambers 82, and has a portion which overlaps the pressure chambers 82 arranged in a corresponding one of the rows, as seen in a plan view of the cavity unit 80.

The auxiliary plate 85, which is held in contact with a lower surface of the manifold plate 86*a*, has auxiliary chambers 94, which are provided by recesses formed on a lower surface thereof and which are isolated from the common chambers 92. The auxiliary chambers 94 are elongated in the Y-axis direction corresponding to the longitudinal direction of the common chambers 92, and overlap the common chambers 92 as seen in the plan view of the cavity unit 80. The auxiliary chambers 94 are isolated from the common chambers 92 by thin bottom walls thereof which are provided by an upper portion of the auxiliary plate 85. Since the auxiliary plate 85 is made of an elastically deformable metallic material, the thin bottom walls are deformable or displaceable toward either the common chambers 92 or the auxiliary chambers 94. Therefore, during a printing operation carried out by the present inkjet printer 100, even where a pressure change caused in each of the pressure chambers 82 is transmitted to the common chamber 92, the pressure change is damped or absorbed by the elastic deformation or oscillation motion of the bottom wall of the auxiliary chamber 94, thereby restraining transmission of the pressure change to the other pressure chambers 82, namely, retraining occurrence of a so-called "cross talk" between the adjacent pressure chambers 82.

Each of the base plate 89, third spacer plate 88 and second spacer plate 87 has four apertures in its end portion, such that each of the four apertures of the base plate 89, a corresponding one of the four apertures of the third spacer plate 88 and a corresponding one of the four apertures of the second spacer plate 87 are aligned with one another in the vertical direction of the cavity unit 80. Each of the above-described ink inlets 81*a*, 81*b*, 81*c*, 81*d* is provided by the vertically aligned apertures formed through the three plates 89, 88, 87. The above-described ink outlets 41 are held in communication with the ink inlets 81*a*, 81*b*, 81*c*, 81*d*, so that the inks supplied from the ink tanks 5 can be delivered into the common chambers 92 via the ink inlets 81.

After being delivered to the common chambers 92, the inks are delivered to the above-described other end portions of the pressure chambers 82 via the connection passages 93 of the second spacer plate 87 and the communication holes 91 of the third spacer plate 88. The inks thus delivered to the pressure chambers 82, upon activation of the piezoelectric actuator 23, are delivered to the nozzles 22 via the through-holes 90 (which are formed through the plates 84-88 as described above).

In the present embodiment in which the number of the ink inlets 81 is four while the number of the common chambers 92 is five (see FIG. 6), the ink inlet 81*a* assigned to the black ink (BK) is held in communication with two of the five common chambers 92 (which are the leftmost two of the five common chambers 92 as seen in FIG. 6), rather than with only one of the five common chambers 92. This arrangement is based on a fact that the black ink (BK) tends to be consumed more than the other color inks. Each of the other ink inlets 81*b*, 81*c*, 81*d* respectively assigned to the cyan ink (C), yellow ink (Y) and magenta ink (M) is held in communication with a corresponding one of the common chambers 92.

The formations of the above-described through-holes and recesses in the plates 84-89 for defining the common chambers 92, through-holes 90, communication holes 91, connection passages 93 and auxiliary chambers 94 are made, for example, by etching, electrical discharge machining, plasma jet machining or laser machining.

On the other hand, the piezoelectric actuator unit 23 is a laminar structure consisting of a plurality of piezoelectric sheets (each having a thickness of about 30 μm) and a top sheet superposed on each other. On an upper surface (i.e., surface having a relatively large width) of each of the lowermost piezoelectric sheet and odd-numbered ones of the piezoelectric sheets (as counted from the lowermost piezoelectric sheet), there are formed individual electrodes in the form of elongated strips which are aligned with the respective pressure chambers 82 of the cavity unit 80 and which are arranged in five rows parallel to the longitudinal direction of the piezoelectric sheet, i.e., the Y-axis direction. Each of the individual electrodes in the five rows is elongated in the X-axis direction (that is perpendicular to the Y-axis direction). The first row of individual electrodes and the fifth row of individual electrodes are located near the respective opposite long side edges of the piezoelectric sheet. On an upper surface of each of even-numbered ones of the piezoelectric sheets (as counted from the lowermost one), there is formed a common electrode which is common to the plurality of pressure chambers 82. On an upper surface of the top sheet, there are formed surface electrodes 95, some of which are electrically connected to the individual electrodes, and the other of which are electrically connected to the common electrodes.

It is noted that the piezoelectric actuator 23 may be a laminar structure consisting of a larger number of piezoelectric sheets, like a piezoelectric actuator disclosed in U.S. Pat. No. 5,402,159 (corresponding to JP-A-H04-341853). The disclosure of U.S. Pat. No. 5,402,159 is hereby incorporated by reference.

The lower surface of the plate-like piezoelectric actuator 23 (i.e., the surface opposed to the pressure chambers 82) is entirely covered by an adhesive sheet (not shown) formed of an ink impermeable synthetic resin, and the piezoelectric actuator 23 is then bonded at the adhesive sheet to the upper surface of the cavity unit 80 such that the individual electrodes are aligned with the respective pressure chambers 82 formed in the cavity unit 80. Further, the flexible flat cable 24 is pressed at its fixed portion 24*b* onto the upper surface of the piezoelectric actuator 23, such that electrically conductive wires (not shown) of the flat cable 24 are electrically connected to the surface electrodes 95.

Next, the damper unit 13 as the ink-channel defining unit will be described in detail by reference to FIGS. 9-14. The damper unit 13 has a primary (horizontal) partition wall 35 and secondary (vertical) partition walls 35*a*, 35*b*, 30 which cooperate with each other to define a total of four mutually-independent damping chambers 27 (27*a*, 27*b*, 27*c*, 27*d*) which are assigned to the respective four colors. In the present embodiment, a first sub-chamber 27*a*-1 of the black ink (BK) damping chamber 27*a* is located on a lower side of the primary partition wall 35, while the cyan ink (C) damping chamber 27*b*, yellow ink (Y) damping chamber 27*c* and magenta ink (M) damping chamber 27*d* (which are separated from each other by the secondary partition walls 35*a*, 35*b*, 30) are located on an upper side of the primary partition wall 35. Thus, the four damping chambers 27 are provided in two layers, i.e., in upper and lower layers.

More specifically described, a damper casing 25 of the damper unit 13 has a generally rectangular, box-like outer wall, and is constituted by an upper casing member 31 and a lower casing member 32 are fluid-tightly fixed to each other, for example, by ultrasonic welding. The lower casing member 32 has a lower opening and an upper opening which is closed by the upper casing member 31 fixedly disposed on the lower casing member 32 (see FIGS. 14A and 14*b*). It is noted that each of the upper and lower casing members 31, 32 is formed, by injection, of a synthetic resin.

The above-described primary partition wall 35 is provided by a portion of the lower casing member 32, and is distant from each of upper and lower surfaces of the lower casing member 32. The lower opening of the lower casing member 32 is defined by a recess which is formed in a major portion of the lower surface of the lower casing member 32. The lower opening of the lower casing member 32 is fluid-tightly closed by a lower flexible film 36 (see FIGS. 13, 14A and 14*b*) which is provided by a thin film formed of synthetic resin and inhibiting permeation of air or liquid therethrough. Described specifically, the lower flexible film 36 is fixed at its outer peripheral portion, for example, by an adhesive or ultrasonic welding, to a lower end face of a peripheral wall 37 of the lower casing member 32 which defines the lower opening of the lower casing member 32 (see FIG. 10). The lower flexible film 36 and the primary partition wall 35 cooperate with each other to define the above-described first sub-chamber 27*a*-1 of the black ink (BK) damping chamber 27*a*. The damper unit 13 is fixed relative to the head holder 20, such that the lower flexible film 36 and the bottom wall 20*a* of the head holder 20 cooperate with each other to define a clearance therebetween which allows deformation of the lower flexible film 36 (see FIG. 13).

Figure 11:
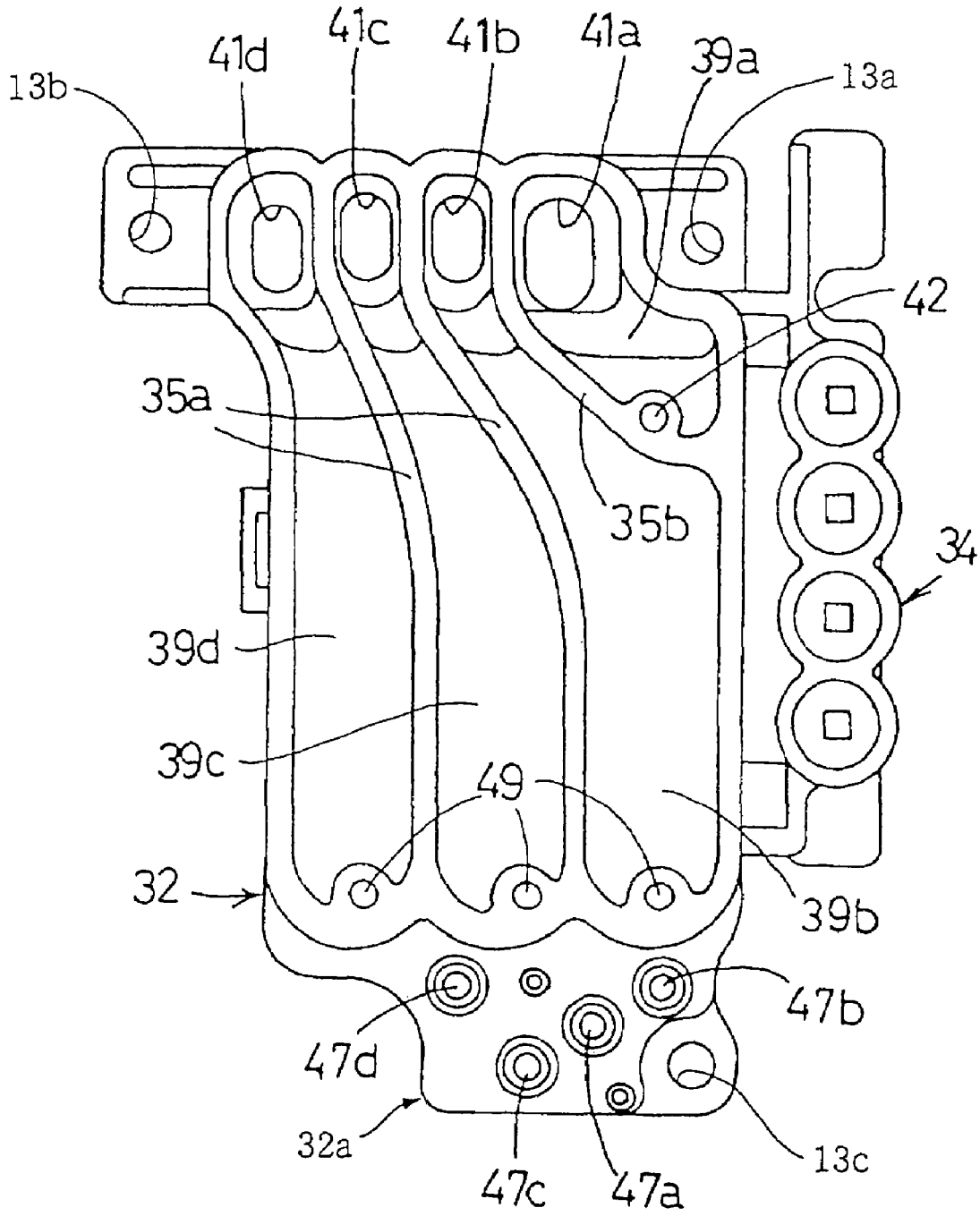
FIG. 11 is a top-plan view of a lower casing member of the damper unit.
Figure 12A:
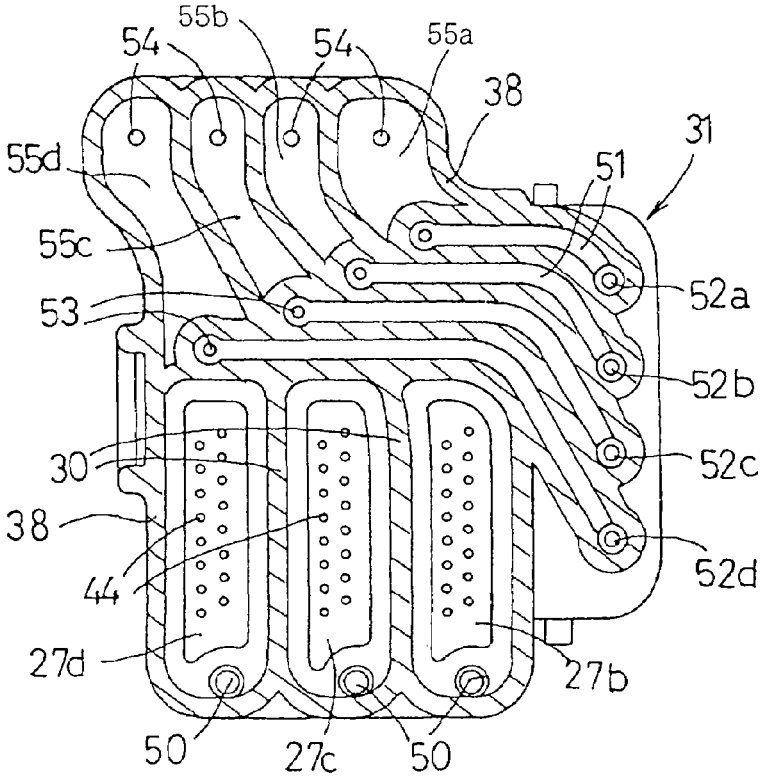
FIG. 12A is a top-plan view of an upper casing member of the damper unit.
Figure 12B:
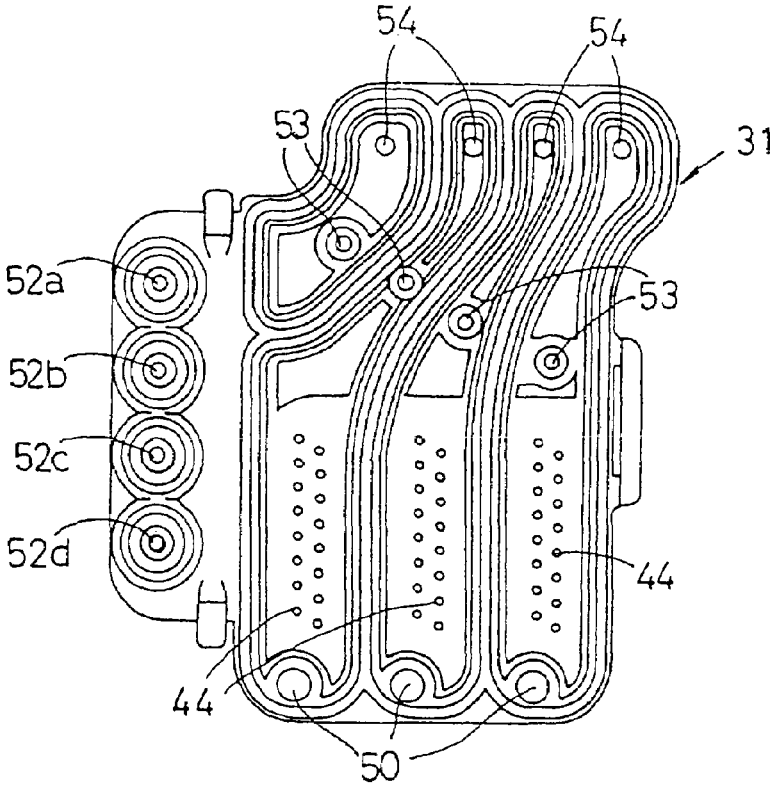
FIG. 12B is a bottom-plan view of the upper casing member of the damper unit.

The two secondary partition walls 35*a* and the one secondary partition wall 35*b* extend upwardly from the upper surface of the primary partition wall 35 (see FIGS. 11 and 13). Thus, an upper portion of the lower casing member 32 (which portion is located on the upper side of the primary partition wall 35) cooperates with the upper casing member 31 to define second sub-chambers 39 (39*a*, 39*b*, 39*c*, 39*d*) of the four damping chambers 27. In the present embodiment, the two secondary partition walls 35*a* which are distant from each other cooperate with a side wall of the lower casing member 32 and the secondary partition wall 35*b* to define the second sub-chambers 39*b*, 39*c*, 39*d* of the cyan ink (C), yellow ink (Y), and magenta ink (M) damping chambers 27*b*, 27*c*, 27*d*. As shown in FIG. 11, the secondary partition walls 35*a* extend horizontally over substantially an entire length of the lower casing member 32. The second sub-chambers 39*b*, 39*c*, 39*d* of the three damping chambers 27*b*, 27*c*, 27*d* are held in communication, at respective portions horizontally distant from the upper surface of the primary partition wall 35, with the respective ink outlets 41*b*, 41*c*, 41*d* which are assigned to the cyan ink (C), yellow ink (Y), and magenta ink (M), respectively.

The secondary partition wall 35*b* cooperates with the side wall of the lower casing member 32 to define the second sub-chamber 39*a* of the black ink (BK) damping chamber 27*a* (see FIG. 11). The secondary partition wall 35*b* extends horizontally to a position which is horizontally distant from the upper surface of the primary partition wall 35 and is near to the ink outlets 41*b*, 41*c*, 41*d*. The second sub-chamber 39*a* of the black ink (BK) damping chamber 27*a* is held in communication at it lower end portion with an ink outlet 41*a* (see FIG. 14B). It is noted that the second sub-chambers 39*a*, 39*b*, 39*c*, 39*d* of the respective four damping chambers 27*a*, 27*b*, 27*c*, 27*d* function as bubble collectors or retainers.

Figure 10:
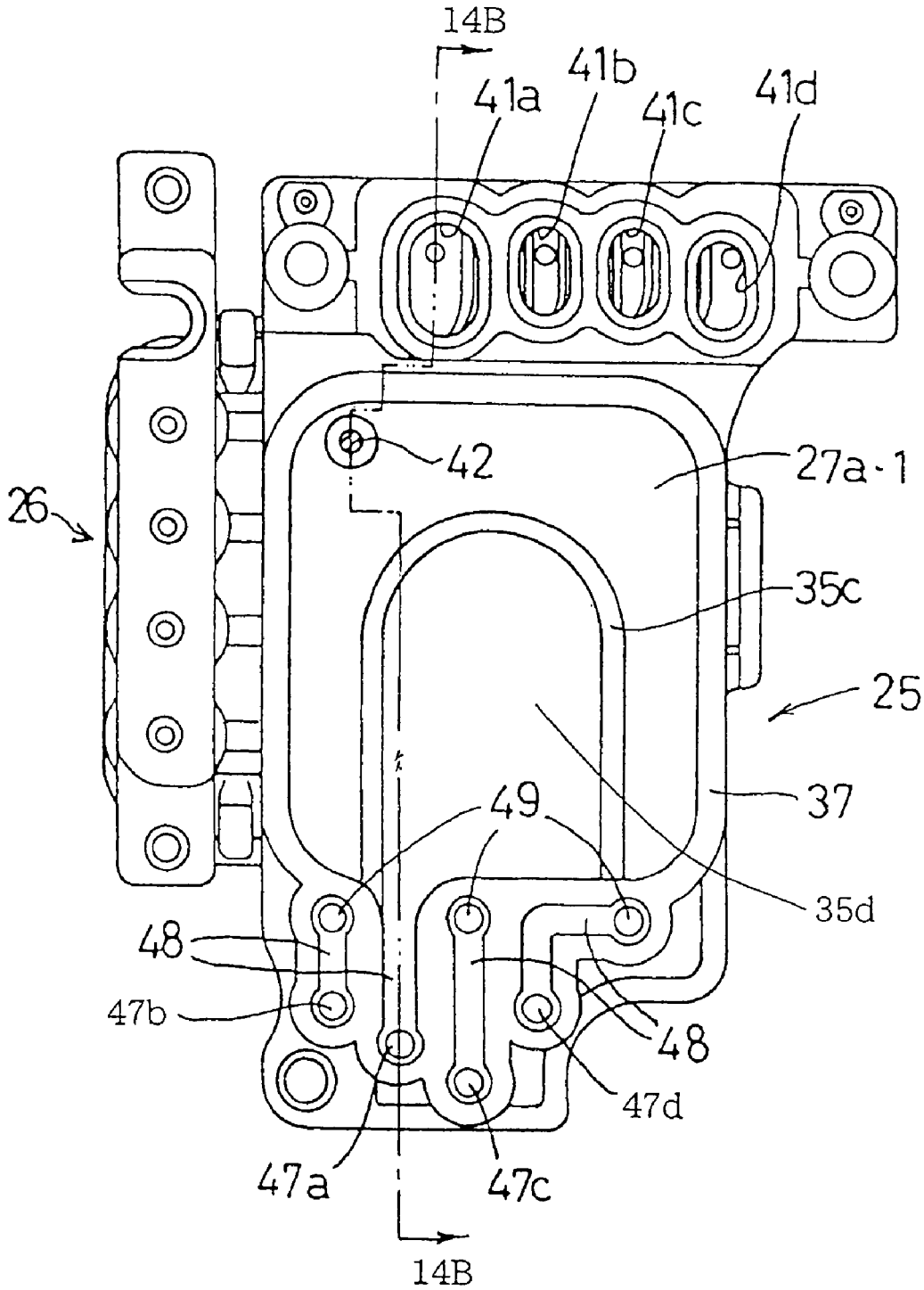
FIG. 10 is a bottom-plan view of the damper unit, in absence of a lower flexible film of the damper unit.
Figure 14A:
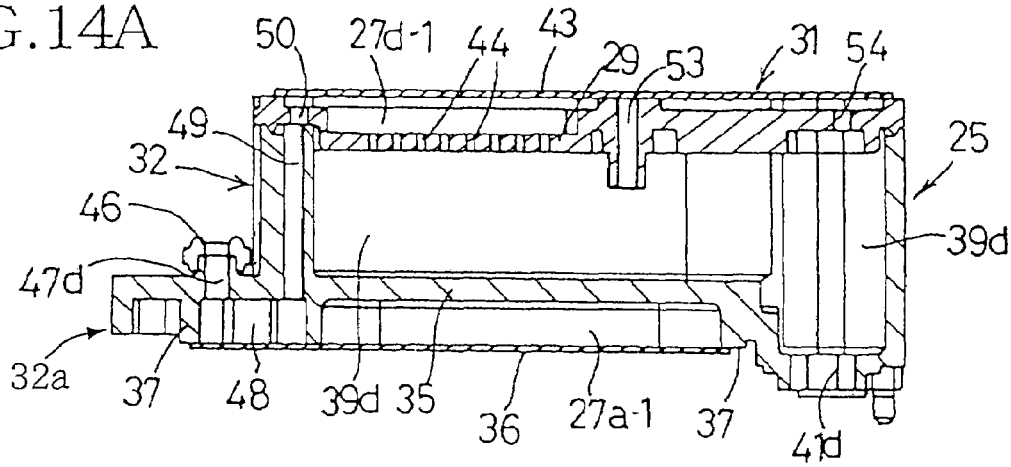
FIG. 14A is a cross sectional view taken along line 14A-14A in FIG. 9.
Figure 14B:
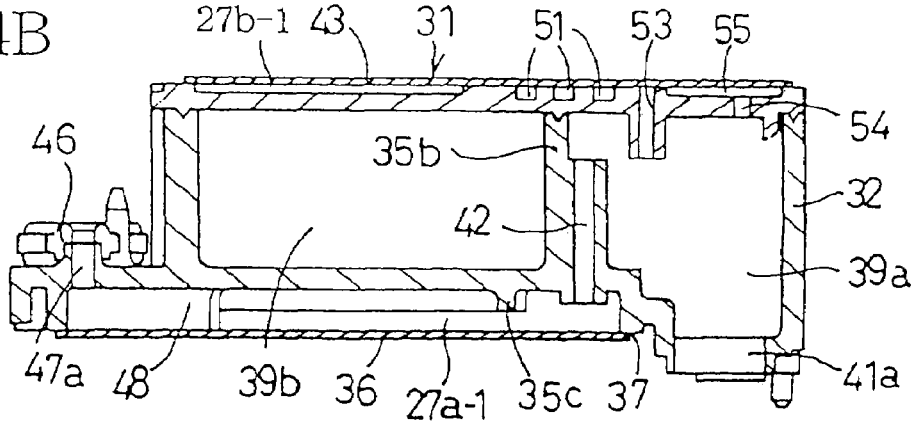
FIG. 14B is a cross sectional view taken along line 14B-14B in FIG. 10.

The first sub-chamber 27*a*-1 of the black ink (BK) damping chamber 27*a* communicates with the second sub-chamber 39*a* of the black ink (BK) damping chamber 27*a*, via a vertically-extending ink flow passage 42 defined by a cylindrical wall which is formed along the secondary partition wall 35*b* (see FIGS. 10, 11 and 14B). The ink flow passage 42 serving as a flow restrictor has a cross sectional area smaller than that of the first sub-chamber 27*a*-1, and accordingly provides a higher resistance to flow of the ink passing therethrough than that of the first sub-chamber 27*a*-1.

The upper casing member 31 is provided by a plate-like member, and has a plurality of recesses formed in an upper surface thereof. The recesses provide first sub-chambers 27*b*-1, 27*c*-1, 27*d*-1 of the cyan ink (C), yellow ink (Y), and magenta ink (M) damping chambers 27*b*, 27*c*, 27*d*, which are separated from each other by the above-described two secondary partition walls 30 (see FIG. 9). The three first sub-chambers 27*b*-1, 27*c*-1, 27*d*-1 are located substantially right above the above-described first sub-chamber 27*a*-1 of the black ink (BK) damping chamber 27*a*, and open upwardly. The two secondary partition walls 30 of the upper casing member 31 lie on respective vertically-extending planes on which the two secondary partition walls 35*a* of the lower casing member 32 respectively lie on (see FIGS. 9 and 11). Lower ends of the respective first sub-chambers 27*b*-1, 27*c*-1,

27*d*-1 of the cyan ink (C), yellow ink (Y), and magenta ink (M) damping chambers 27*b*, 27*c*, 27*d* are defined by a bottom wall 29 which has a plurality of vertically-extending communication holes 44 formed therethrough (see FIG. 14A). The communication holes 44 cooperate with each other to function as a flow restrictor, like the above-described ink flow passage 42. Each of the three first sub-chambers 27*b*-1, 27*c*-1, 27*d*-1 communicates, via the communication holes 44, with a chamber located right below each of the first sub-chambers, namely, with a corresponding one of the three second sub-chambers 39*b*, 39*c*, 39*d* which are defined by the secondary partition walls 35*a* in the lower casing member 32.

Each of the communication holes 44 has a cross sectional area smaller than that of each of the three first sub-chambers 27*b*-1, 27*c*-1, 27*d*-1, and accordingly provides a higher resistance to flow of the ink passing therethrough than that of each of the first sub-chambers 27*b*-1, 27*c*-1, 27*d*-1.

Upper open ends of the three first sub-chambers 27*b*-1, 27*c*-1, 27*d*-1 of the of the cyan ink (C), yellow ink (Y), and magenta ink (M) damping chambers 27*b*, 27*c*, 27*d* are commonly closed by an upper flexible film 43 (see FIG. 14A) which is provided by a single thin film formed of synthetic resin and inhibiting permeation of air or liquid therethrough. Described specifically, the upper flexible film 43 is fixed, for example, by an adhesive or ultrasonic welding, to upper end faces of a peripheral wall and the two secondary partition walls 30 which define the three first sub-chambers 27*b*-1, 27*c*-1, 27*d*-1.

As shown in FIG. 10, the above-described four ink outlets 41*a*, 41*b*, 41*c*, 41*d* are arranged in a row in the lower surface of the lower casing member 32, and have respective openings which open downwardly and which are located in a height position lower than a height position of the lower flexible film 36 (see FIGS. 14A and 14B). Meanwhile, the front head unit 21 has, in the upper surface thereof, the four ink inlets 81*a*, 81*b*, 81*c*, 81*d* each of which communicates with an end of a corresponding one of the four ink supply channels (i.e., four common chambers) assigned to the respective four colors. The four ink outlets 41*a*-41*d* are held in communication, through the above-described aperture 20*b* formed through the bottom wall 20*a* of the head holder 20, with the respective four ink inlets 81*a*-81*d* (which are opposed to the respective four ink outlets 41*a*-41*d*), with the above-described elastic sealing member 67 interposed therebetween (see FIG. 8).

Figure 9:
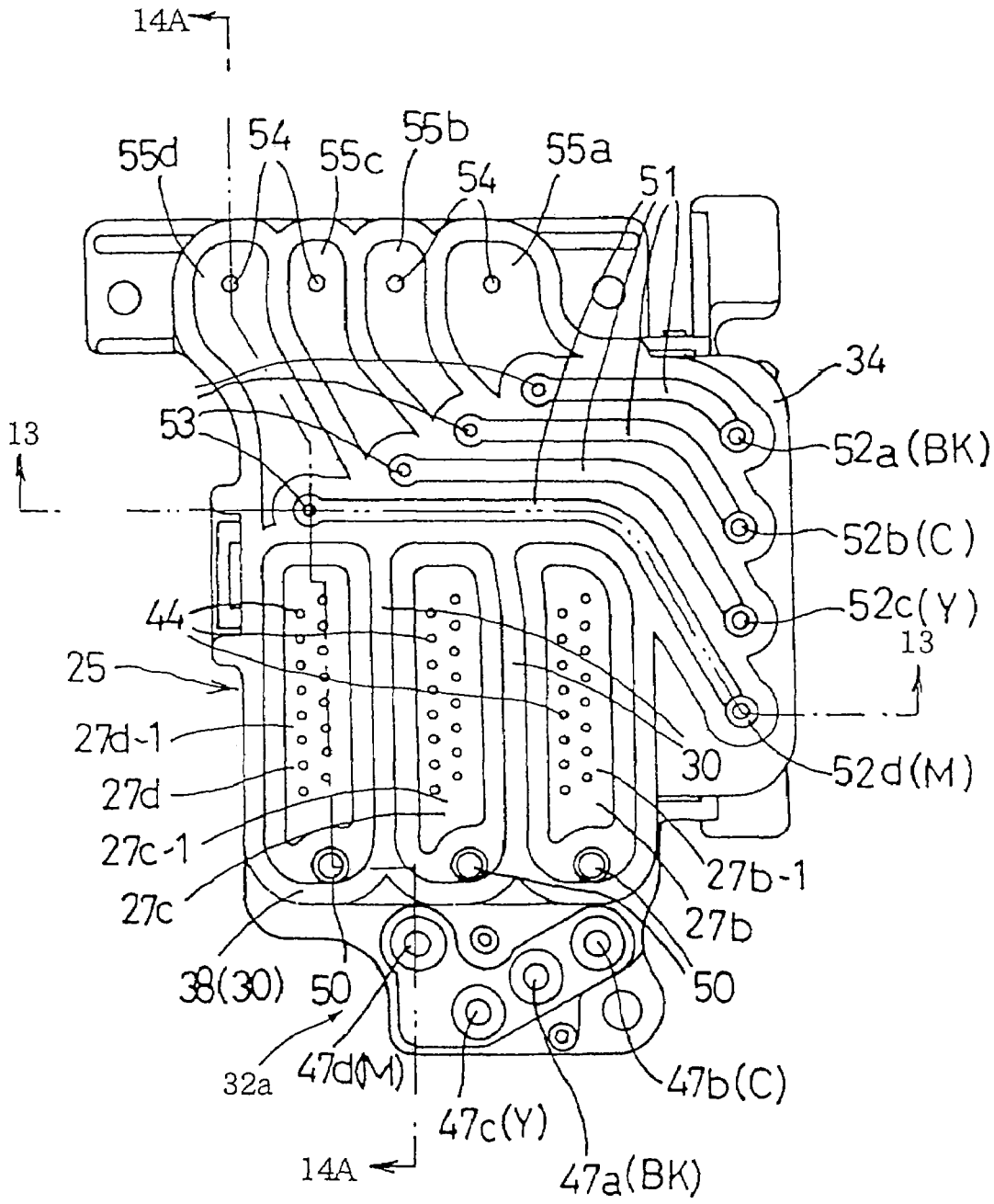
FIG. 9 is a top-plan view of the damper unit, in absence of an upper flexible film of the damper unit.

The lower casing member 32 includes a flange-like projecting portion 32*a* located in one of opposite end portions thereof that is remote from the ink outlets 41 as viewed in the Y-axis direction (see FIGS. 4, 9 and 11). The projecting portion 32*a* has four ink inlets 47 (47*a*, 47*b*, 47*c*, 47*d*) which open upwardly and which are assigned to the black ink (BK), the cyan ink (C), the yellow ink (Y), and the magenta ink (M), respectively.

Four joint members 45 are connected to the respective four ink inlets 47 via respective sealing members 46 such as rubber packing members (see FIG. 4). The joint members 45 are connected at their respective distal ends to the four ink supply tubes 14*a*, 14*b*, 14*c*, 14*d* which are assigned to the respective four colors. Thus, each of the ink supply tubes 14 is connected at its upstream end with the corresponding ink tank 5, and is connected at its downstream end with the corresponding joint member 45.

The ink inlet 47*a* assigned to the black ink (BK) is held in communication with the first sub-chamber 27*a*-1 of the black ink damping chamber 27*a* via a corresponding one of horizontal connection passages 48 which are provided by respective downwardly-opening recesses formed in the lower surface of the lower casing member 32 (see FIGS. 10 and 14B). The other three ink inlets 47*b*, 47*c*, 47*d* assigned to the other colors of inks are held in communication with the respective first sub-chambers 27*b*-1, 27*c*-1, 27*d*-1 of the other three damping chambers 27*b*, 27*c*, 27*d* via the other horizontal connection passages 48, respective three vertical communication passages 49 formed within the side wall of the lower casing member 32 and extending in the vertical direction (i.e., in a direction substantially perpendicular to the primary partition wall 35), and respective three vertical communication passages 50 formed through the upper casing member 31 and extending in the vertical direction (see FIGS. 10 and 14A).

During a printing operation by the present inkjet printer 100, as the carriage 9 is reciprocated in the X-axis direction (i.e., in the leftward and rightward directions as seen in FIG. 1), the ink supply tubes 14 are also moved in the X-axis direction so as to follow the carriage 9. In this instance, the pressure of the ink contained in each of the ink supply tubes 14 is considerably changed, upon returning of the carriage 9, due to an inertia force acting on the ink supply tubes 14. This pressure change caused in each ink supply tube 14 is propagated to the corresponding damping chamber 27 via the corresponding ink inlet 47. In the present embodiment, upper open ends of the respective three vertical communication passages 50 of the upper casing member 31 are located in a height position close to a lower surface of the upper flexible film 43 (see FIG. 14A), so that the inks flowing into the first sub-chambers 27*b*-1, 27*c*-1, 27*d*-1 through the open ends of the communication passages 50 can directly collide with the flexible film 43 that is close and opposed to the upper open ends of the communication passages 50, whereby the change of dynamic pressure of the inks induced within the flexible ink supply tubes 14*b*, 14*c*, 14*d* can be efficiently absorbed or damped by the flexible film 43.

The above-described downwardly-opening recesses providing the horizontal connection passages 48 (which communicate with the ink inlets 47*a*-47*d*) are covered by the lower flexible film 36 (see FIGS. 14A and 14B).

On the lower surface of the primary partition wall 35, namely, on a ceiling surface of the first sub-chamber 27*a*-1 of the black ink damping chamber 27*a*, there is formed a rib 35*c* which has a generally U shape as viewed in its plan view (see FIGS. 10 and 14B). The U-shaped rib 35*c* is connected at its opposite ends to portions of the peripheral wall 37 of the lower casing member 32 which are close to the horizontal connection passages 48. The rib 35*c* has a lower end which is distant from the lower flexible film 36, as viewed in the vertical direction (see FIG. 14B). In this construction, the black ink does not enter a space 35*d* (see FIG. 10) surrounded by the U-shaped rib 35*c*, so that shi space 35*d* and the lower flexible film 36 cooperate with each other to absorb the change of pressure of the black ink.

The upper casing member 31 has, in its upper surface, four recesses which provide respective third sub-chambers 55*a*, 55*b*, 55*c*, 55*d* of the four damping chambers 27*a*, 27*b*, 27*c*, 27*d*, in respective positions that are vertically aligned with portions of the respective second sub-chambers 39*a*, 39*b*, 39*c*, 39*d* which are close to the four ink outlets 41*a*, 41*b*, 41*c*, 41*d*, such that the four third sub-chambers 55*a*, 55*b*, 55*c*, 55*d* are independent of each other (see FIGS. 9, 11, 14A and 14B). The four third sub-chambers 55*a*, 55*b*, 55*c*, 55*d* communicate with the corresponding second sub-chambers 39*a*, 39*b*, 39*c*, 39*d* via respective air holes 54 formed through the upper casing member 31 (see FIGS. 9, 14A and 14B). That is, each of the four damping chambers 27 assigned to the respective four color inks includes three sub-chambers, i.e., the first sub-chamber 27-1, the second sub-chamber 39, and the third sub-chamber 55.

In addition, in the upper surface of the upper casing member 31, there are formed four elongated recesses providing four air discharging passages 51 which extend generally in a direction perpendicular to a longitudinal direction of the damper casing 25 in which the four ink inlets 47*a*-47*d* and the four ink outlets 41*a*-41*d* are opposite to each other (see FIG. 9). Moreover, there are formed four air discharging holes 53 which are located between the three first sub-chambers 27*b*-1, 27*c*-1, 27*d*-1 and the four third sub-chambers 55*a*, 55*b*, 55*c*, 55*d*, as seen in the plan view of the upper casing member 31 (see FIG. 9). The four air discharging holes 53 are formed through the upper casing member 31 so as to be held in communication at their respective lower ends with the respective four second sub-chambers 39*a*, 39*b*, 39*c*, 39*d*. Each of the four air discharging passages 51 is connected at one of its opposite ends with a corresponding one of the four air discharging holes 53 and is connected at the other end with a corresponding one of four connection holes 52*a*, 52*b*, 52*c*, 52*d* which are in turn connected to the bubble discharger 26 that is described later in detail (see FIGS. 9 and 13).

The vertically-extending air discharging holes 53 are formed through respective tubular walls which project downwardly from the upper casing member 31 into the respective second sub-chambers 39*a*, 39*b*, 39*c*, 39*d* (see FIGS. 13, 14A and 14B). The air discharging holes 53 have respective lower openings which open in the respective second sub-chambers 39 and which are positioned in respective height positions distant from the upper casing member 31 by a predetermined vertical distance. In this arrangement, even after the air bubbles have been discharged from each of the second sub-chambers 39 via the corresponding air discharging hole 53, an air layer whose thickness corresponds to the above-described predetermined vertical distance (i.e., distance of the downward projection of the tubular walls from the upper casing member 31) is left in an upper portion of the second sub-chamber 39. In addition, usually, an air layer is kept also in each of the third sub-chambers 55*a*, 55*b*, 55*c*, 55*d*, and contributes to damp or absorb the change of pressure of the ink induced in a corresponding one of the damping chambers 27*a*, 27*b*, 27*c*, 27*d*, so that ink droplets are ejected under uniform ejection pressures through the nozzles 22*a*, 22*b*, 22*c*, 22*d* of the front head unit 21, resulting in an improved quality of the image printed by the present inkjet printer 100.

The above-described recesses providing the third sub-chambers 55*a*, 55*b*, 55*c*, 55*d* of the four damping chambers 27*a*, 27*b*, 27*c*, 27*d* and the four air discharging passages 51 are covered by the upper flexible film 43 (see FIGS. 14A and 14B).

The damper unit 13 is fixed relative to the carriage 9, such that the primary partition wall 35 and the upper and lower flexible films 36, 43 extend in parallel with the direction in which the carriage 9 is to be moved, namely, in parallel with the outside surface of the front head unit 21 in which the nozzles 22 open.

Next, the bubble discharger 26 will be described in detail. The lower casing member 32 includes an integrally formed, accommodating portion 34 which is located in its end portion (i.e., in its right end portion as seen FIGS. 9 and 13) and which accommodates the bubble discharger 26. This accommodating portion 34 has four vertically-extending communication holes 56 assigned to the four color inks and connected at their respective upper ends to the respective communication holes 52 (which are in turn connected to the respective air discharging passages 51, as described above). The accommodating portion 34 is covered at its upper end by the upper casing member 31 (see FIGS. 9 and 13).

Each of the four communication holes 56 has an upper large-diameter portion 56*a* and a lower small-diameter portion 56*b* (see FIG. 13). Within each of the communication holes 56, there is disposed a valve member including a large-diameter valve head portion 57 and a small-diameter valve stem portion 58 which extends downwardly from the head portion 57. A sealing member 59, which is preferably provided by an elastic packing member, is disposed on a lower side of the valve head portion 57 of the valve member. In this embodiment, the sealing member 59 takes the form of an O-ring which is mounted on the valve stem portion 58 of the valve member. Further, a biaser 60 such as a coil spring is disposed within the upper large-diameter portion 56*a* of each communication hole 56, so as to bias the valve member in such a direction that causes the lower small-diameter portion 56*b* of the communication hole 56 to be closed. The valve stem portion 58 of the valve member is received in the lower small-diameter portion 56*b*, such that a lower end of the valve stem portion 58 is located in the vicinity of a lower opening end of the small-diameter portion 56*b* of the communication hole 56 (see FIG. 13).

Each valve member including the head portion 57 and the stem portion 58 is constantly biased in the downward direction by the biaser 60, so that the sealing member 59 is pressed or gripped by and between the valve head portion 57 and a valve seat which is provided by a bottom surface of the upper large-diameter portion 56*a* of the communication hole 56, whereby the valve member is held in its closed state (see FIG. 13). It is noted that each valve member is placed in its open state, when the valve member is lifted up by a projection portion 72*a* of a cap member 72 which is brought into contact with the valve stem portion 58.

The maintenance unit 4 includes a covering member 71 which is operable to cover the nozzle opening surface of the front head unit 21 so as to cover all the nozzles 22; and four cap members 72 which are operable independently of each other to cover the lower opening ends of the respective four lower small-diameter portions 56*b* of the communication holes 56 (see FIG. 13). The maintenance unit 4 further includes an elevating and lowering device 73 that is employed in a known maintenance unit. When the carriage 9 carrying the printer head 3 is positioned in its home position (i.e., in the right end position as seen FIG. 1), the covering member 71 and the cap members 72 are elevated by this elevating and lowering device 73, so as to be brought into close contact with the nozzle opening surface of the front head unit 21 and the lower end surface of the bubble discharger 26, for closing the openings of the nozzles 22 and the lower openings of the communication holes 56. When the carriage 9 is away from its home position, the covering member 71 and the cap members 72 are lowered by the elevating and lowering device 73 so as to be separated from those surfaces. The covering member 71 is operatively connected to a suction pump 74, like in the known maintenance unit, so that thickened ink and foreign matters can be sucked, with activation of the suction pump 74, through the covering member 71, so as to be removed from the nozzles 22.

The four cap members 72 have the respective projection portions 72*a* projecting upwardly from main bodies of the respective cap members 72. When the cap members 72 are brought into contact with the lower end surface of the bubble discharger 26, the projection portions 72*a* push the valve stem portions 58 of the valve members upwardly against biasing forces generated by the biasers 60, whereby the sealing members 59 are moved, together with the valve members, away from the valve seats (i.e., the bottom surfaces of the upper large-diameter portions 56*a* of the communication holes 56), namely, whereby the valve members are placed in their open states. The four cap members 72 are operatively connected to the suction pump 74 via a common flow passage, so that the air bubbles collected or retained in the second sub-chambers 39*a*, 39*b*, 39*c*, 39*d* of the respective four damping chambers 27 are concurrently sucked and discharged with activation of the suction pump 74. In the inkjet printer head 3 constructed according to the present embodiment, while the four color inks supplied from the ink tanks 5 via the flexible ink supply tubes 14 are temporarily stored in the second sub-chambers 39*a*-39*d*, the air bubbles are separated from the inks and floated on upper surfaces of the inks. The thus separated air bubbles are collected or retained in the upper portions of the second sub-chambers 39*a*-39*d*, and the retained air bubbles are then sucked and discharged by the suction pump 74.

A selector valve 75 is provided to selectively connects the covering member 71 or the cap members 72, to the suction pump 74. Although the covering member 71 and the cap members 72 are concurrently elevated by the elevating and lowering device 73 so as to be brought into close contact with the outside surface of the front head unit 21 and the lower surface of the bubble discharger 26, it is preferable that the air bubbles retained in the upper portions of the second sub-chambers 39*a*-39*d* are first discharged via the cap members 72, and the thickened inks are then discharged from nozzles 22 via the covering member 71. If the air bubbles retained in the second sub-chambers 39*a*-39*d* were intended to be discharged through only the covering member 71, considerably large amounts of inks would have to be discharged. However, in the present embodiment, the discharge of the air bubbles and the recovery of the front head unit 21 can be made by discharging reduced amounts of inks. It is noted that the operation of sucking the inks from the nozzles 22 and the operation of discharging the air bubbles from the second sub-chambers 39*a*-39*d* may be performed either together with each other or independently of each other.

The suction pump 74 may be replaced with a positive-pressure applying pump which is arranged to apply a positive pressure (i.e., a pressurized air) to the inks stored in the ink tanks 5, for removing the thickened inks and foreign matters from the nozzles 22, and discharging the air bubbles from the second sub-chambers 39*a*-39*d*. Further, it is also possible to employ both the suction pump 74 and the positive-pressure applying pump.

Next, there will be described a process of assembling the printer head 3, which is constructed as described above. In the present embodiment, the front head unit 21 and the reinforcement member 65 are bonded with the adhesive sheet 68 interposed therebetween (see FIG. 8), such that each of the ink inlets 81 of the cavity unit 80 and a corresponding one of the ink passage holes 66 of the reinforcement member 65 are aligned with each other. In this instance in which the front head unit 21 and the reinforcement member 65 are bonded to each other, the piezoelectric actuator 23 and the flat cable 24 are exposed upwardly through the aperture 65*a* of the reinforcement member 65, and the flexible portion 24*c* of the flexible flat cable 24 is made to extend upwardly through the aperture 65*a* of the reinforcement member 65. The front head unit 21 and the reinforcement member 65, between which the adhesive sheet 68 is interposed, are pressed against each other and heated, so as to be fixed to each other by the cured adhesive sheet 68. The thus fixed front head unit 21 and reinforcement member 65 cooperate with each other to constitute a sub-assembly which can be handled as a single unit in the subsequent steps.

The sub-assembly constituted by the front head unit 21 and the reinforcement member 65, is then fixedly bonded to a lower surface of the bottom wall 20*a* of the head holder 20 by using an adhesive such as UV adhesive. In this instance, the sub-assembly and the head holder 20 are positioned relative to each other, such that the ink passage holes 66 of the reinforcement member 65 are exposed upwardly through the aperture 20*b* of the head holder 20, and such that the flexible portion 24*c* of the flat cable 24 is made to extend upwardly through the slit 20*c* of the head holder 20 (see FIGS. 4 and 13). The used adhesive can be applied through the through-holes 20*d* of the head holder 20, onto a surface of the sub-assembly which is to be bonded to the head holder 20. It is noted that a gap between a periphery of the front head unit 21 and a peripheral wall of the head holder 20 is filled with an adhesive or filler.

Next, the elastic member 16 is disposed above the row of the through-holes 20*d* which is close to the slit 20*c*, and the driver circuit 24*a* of the flat cable 24 is disposed on an upper flat surface of the elastic member 16 (see FIG. 13).

Next, the heat dissipater 15 having the generally inverted U shape in its cross section is hung on the side wall 20*e* of the head holder 20 (see FIG. 13). In this instance, the flexible portion 24*c* of the flat cable 24 is made to extend upwardly through the cutout 15*d* of the heat dissipater 15, while each of the projections 20*g* of the head holder 20 is made to pass through a corresponding one of the through-holes 15*c* of the heat dissipater 15, whereby the heat dissipater 15 is brought into contact with an upper surface of the driver circuit 24*a* (see FIG. 13). The upper end portion of each projection 20*g* is heat-fused to have an increased diameter, so that the heat dissipater 15 is fixed relative to the head holder 20, with the driver circuit 24*a* being gripped by and between the elastic member 16 and the contact portion 15*a* of the heat dissipater 15. It is noted that the heat dissipater 15 is forced toward the head holder 20 upon fixing of the heat dissipater 15 relative to the head holder 20, so that the driver circuit 24*a* can be constantly biased by the elastic member 16 toward the contact portion 15*a* of the heat dissipater 15, after the fixing.

Finally, the damper unit 13 is mounted on the head holder 20, such that each of the ink inlets 41 of the damper unit 13 and a corresponding one of the ink passage holes 66 of the reinforcement member 65 are aligned with each other, with the elastic sealing member 67 being interposed therebetween. The three screws 17 are used to pass through the respective through hoes 13*a*-13*c* of the damper unit 13, and are screwed into the respective tapped holes 65*a*-65*c* of the reinforcement member 65 (see FIGS. 3 and 7). Thus, the ink inlets 81 and the ink inlets 41 are connected through the elastic sealing member 67 and the ink passage holes 66 (see FIG. 4). Since the elastic sealing member 67 is held compressed between the damper unit 13 and the reinforcement member 65 owing to the fixture by means of the screws 17, a fluid-tight connection between the ink outlets and inlets 41, 81 is assured by the compressed sealing member 67, without risk of leakage of the inks. Further, the damper unit 13 can be easily removed by unscrewing the screws 17, for example, when it needs to be replaced with a new one.

In the inkjet printer head 3 constructed as described above, the front head unit 21 is secured to the reinforcement member 65, and is accordingly given an increased rigidity. Therefore, even where the damper unit 13 and the reinforcement member 65 are so tightly fastened that the elastic sealing member 67 interposed therebetween is compressed, the front head unit 21 is free from deformation, owing to the reinforcement member 65 which supports a reaction force exerted by the compressed elastic sealing member 67.

As discussed above in the Discussion of Related Art, the inkjet printer head disclosed in U.S. Pat. No. 6,652,081 requires the sleeve which is fitted in the O-ring as an elastic sealing member and also the backup member which receives the reaction force exerted by the compressed O-ring. In the inkjet printer head 3 constructed according to the invention, the reinforcement member 65 consisting of a single element provides the same functions as those provided by the sleeve and the backup member in the printer head disclosed in U.S. Pat. No. 6,652,081. Thus, the printer head 3 can be constructed with a reduced number of components.

Further, in the printer head 3, the reinforcement member 65 is bonded to substantially an entirety of the front head unit 21, so that the front head unit 21 is supported substantially in its entirety by the reinforcement member 65 having a high degree of rigidity. Therefore, in a process of manufacturing the printer head 3, the reinforcement member 65 cooperates with the front head unit 21 to constitute the rigid sub-assembly which is to be attached to or removed from the other components such as the head holder 20 and the damper unit 13. That is, the front head unit 21 can be attached or removed, together with the rigid reinforcement member 65, to or from the other components, thereby assuring a higher degree of stability of its ink ejection characteristic, than in a case where the front head unit 21 is individually attached to or removed from the other components. Further, in steps following to the step in which the front head unit 21 and the reinforcement member 65 are bonded to each other, the sub-assembly constituted by the front head unit 21 and the reinforcement member 65 can be easily handled as a single unit.

Further, in the printer head 3, the damper unit 13, which is disposed on the upper surface of the bottom wall 20*a* of the head holder 20, is fixed to the reinforcement member 65 through the screws 17, whereby the front head unit 21 is backupped not only by the reinforcement member 65 but also by the head holder 20 and the damper unit 13. That is, the front head unit 21 constitutes a part of an assembly having a large size as measured in the vertical direction, i.e., in a direction perpendicular to the nozzle opening or outside surface of the front head unit 21, whereby the rigidity of the front head unit 21 is further increased.

In the conventional front head unit, for example, when the inks are concurrently ejected through the nozzles arranged in two or more adjacent rows, the ejections of the inks are affected by each other due to occurrence of the "cross talk" between the adjacent rows of the nozzles. The above-described increase in the rigidity of the front head unit 21 is effective to restrain vibration of the cavity unit 80 caused by the activation of the piezoelectric actuator 23 and accordingly prevent propagation of vibration between the adjacent rows of the nozzles 90. Thus, the printer head 3 equipped with the rigid front head unit 21 is capable of performing a reliable printing operation, assuring a higher degree of stability of its ink ejection characteristic.

Further, in the printer head 3, the damper unit 13 and the reinforcement member 65 are connected, at their portions located inside the aperture 20*b* which is formed through the bottom wall 20*a* of the head holder 20, to each other by the screws 17. That is, the fluid-tight connection between the ink outlets and inlets 41, 81 is established by the connection between the damper unit 13 and the reinforcement member 65, and is not influenced by the head holder 20. Therefore, the printer head 3 is free from an ink leakage even in the event of separation of the head holder 20 from the front head unit 21 and the reinforcement member 65.

Further, since the reinforcement member 65 is made of a metallic material, the reinforcement member 65 has a coefficient of linear expansion which is close to that of the front head unit 21 which is also made of a metallic material. Therefore, the printer head 3 is highly resistant to an environmental change causing, for example, a thermal shock, and does not suffer from drawbacks, which could be caused by the environmental change, such as separation of the reinforcement member 65 and the front head unit 21 from each other. In addition, since the adhesive sheet 68 interposed between the reinforcement member 65 and the front head unit 21 has a certain thickness as measured after it has been cured, a difference between the reinforcement member 65 and the front head unit 21 in linear expansion is absorbed in the environmental change, whereby the above-described separation can be further effectively prevented.

Further, since the reinforcement member 65 and the front head unit 21 are bonded by the adhesive sheet 68 rather than a liquid adhesive, it is possible to avoid such a problem that would be caused if the adhesive flows into the ink inlets 81. In addition, it is possible to minimize unevenness in the application of the adhesive, and easily control the thickness of the applied adhesive.

Further, where the adhesive sheet 68 has a Youngs modulus of 1-1000 MPa, a melting point of 80-180° C., a thickness of 5-100 μm (as measured after it has been cured) and a bonding strength of at least 10 N, the adhesive sheet 68 contributes to prevent occurrence of the "cross talk" between the adjacent rows of the nozzles 22, like the increased rigidity of the front head unit 21, which also contributes to prevent occurrence of the "cross talk" as described above.

Further, where the reinforcement member 65 is somewhat warped and does not have a high degree of flatness, the adhesive sheet 68 contributes to prevent deterioration in flatness of the front head unit 21. That is, when the adhesive sheet 68 is pressed between the reinforcement member 65 and the front head unit 21 with application of heat thereto, the adhesive sheet 68 is softened and thinned in such a compensating manner that minimizes reflection of the warp of the reinforcement member 65 on the flatness of the front head unit 21.

Further, since the adhesive sheet 68 interposed between the reinforcement member 65 and the front head unit 21 is configured to continuously surround the piezoelectric actuator 23, the piezoelectric actuator 23 is protected by the adhesive sheet 68 from the inks. Therefore, even if the inks flow onto the inside or side surface of the front head unit 21, for example, when the nozzle opening surface of the front head unit 21 is subjected to the cleaning treatment by the maintenance unit 4, or when the nozzle opening surface is wiped with a wiper, it is possible to avoid the piezoelectric actuator 23 from being exposed to the inks, thereby preventing problems such as undesirable electrical connection between the electrodes of the piezoelectric actuator 23 via the inks. In addition, since the adhesive sheet 68 is configured such that each of the ink inlets 81 is completely surrounded at its periphery by the adhesive sheet 68, it is possible to prevent the inks from leaking out of the ink inlets 81 between the opposed surfaces of the reinforcement member 65 and the cavity unit 80.

In the inkjet printer 100 constructed as described above, during a printing operation, the piezoelectric actuator 23 is driven in response to a drive signal outputted from the drive circuit 24*a*, for ejecting the ink droplets onto the paper sheet P through the nozzles 22, while at the same time the heat generated by the drive circuit 24*a* is dissipated by the heat dissipater 15. In this instance, the generated heat is transferred to the exposed portion 15*b* of the heat dissipater 15 through the contact portion 15*a* which is held in contact with the driver circuit 24*a*, and the thus transferred heat is eventually released from the exposed portion 15*b*.

After the printing operation, the carriage 9 is returned to its home position in which the maintenance unit 4 is located. While the carriage 9 is held in its home position, the valve members (each including the valve head portion 57 and the valve stem portion 58) and the sealing members 59 of the bubble discharger 26 are moved upwardly by the projection portions 72*a* of the cap members 72, whereby the valve members are placed in their respective open states. With the valve members being held in their respective open states, the suction pump 74 is activated to suck the air bubbles retained in the upper portions of the second sub-chambers 39*a*-39*d* of the damping chambers 27, whereby the air bubbles are discharged to the exterior via the air discharging passages 51 and the communication holes 56 of the bubble discharger 26. Thus, the air bubbles are prevented from entering the front head unit 21.

In the inkjet printer 100, as described above, the heat dissipater 15, the bubble discharger 26 and the front head unit 21 mounted on the carriage 9 are arranged in the primary scanning direction (i.e, in the X-axis direction). In other words, in this arrangement, the heat dissipater 15, the bubble discharger 26 and the front head unit 21 are arranged in a direction in which a space (required for allowing the reciprocating motion of the carriage 9) is elongated, thereby eliminating a need of providing another space exclusively serving for the dispositions of the heat dissipater 15 and the bubble discharger 26. Further, owing to this arrangement, the carriage can be made small in its dimension as measured in the secondary scanning direction, whereby the inkjet printer 100 in its entirety can made compact.

The heat dissipater 15 includes the contact portion 15*a* which is held in contact with the driver circuit 24*a*, and the exposed portion 15*b* which is contiguous to the contact portion 15*a* and which is located outwardly of the carriage 9 as viewed in the primary scanning direction. Therefore, the heat generated by the driver circuit 24*a* is first received by the contact portion 15*a*, and is then transferred to the exposed portion 15*b* which is exposed to the exterior, so that the heat is eventually dissipated to the exterior.

Further, as described above, the heat dissipater 15 provided by the bent plate member is hung on the side wall 20*e* of the head holder 20 such that the contact portion 15*a* and the exposed portion 15*b* vertically extend along the inner surface and the outer surface of the side wall 20*e*, respectively. This arrangement makes it possible to minimize a dimension of the heat dissipater 15 as measured in the primary scanning direction. This means that the provision of the heat dissipater 15 on the carriage 9 does not impede the movement of the carriage 9 over a required distance in the primary scanning direction. Further, since the side wall 20*e* of the head holder 20 is interposed between the contact portion 15*a* and the exposed portion 15*b*, the driver circuit 24*a* is protected by the side wall 20*e* from the heat which has been once dissipated from the exposed portion 15*b*, namely, the driver circuit 24*a* is not affected by the heat dissipated from the exposed portion 15*b*.

Further, since the heat dissipater 15 is made of a metallic material, it has a high degree of heat transfer capacity, and also high degrees of formability and machinability so as to be easily given a desired shape or configuration.

Further, as described above, the exposed portion 15*b* of the heat dissipater 15 extends along the outside surface of the side wall 20*e* of the head holder 20 such that the major surface of the exposed portion 15*b* is held substantially in perpendicular to the primary scanning direction (i.e., the X-axis direction). In this arrangement, the heat dissipater 15 can dissipate the heat to a large open space which is provided for allowing the reciprocating motion of the carriage 9 in the primary scanning direction. Further, since the exposed portion 15*b* can be cooled by wind which is generated by the reciprocating motion of the carriage 9 and is fully received by the major surface of the exposed portion 15*b*, the heat can be dissipated by the heat dissipater 15 with a high efficiency.

Still further, since the driver circuit 24*a* is gripped by and between the head holder 20 and the contact portion 15*a* of the heat dissipater 15, the heat is reliably transferred from the driver circuit 24*a* to the contact portion 15*a* of the heat dissipater 15.

While the preferred embodiment of this invention has been described above, it is to be understood that the invention is not limited to the details of the illustrated embodiment, but may be embodied with various changes and modifications, which may occur to those skilled in the art, without departing from the sprit and scope of the present invention.

In the above-described embodiment, the box-like head holder 20 is mounted on the frame-like carriage 9, and the heat dissipater 15 and the bubble discharger 26 are disposed on the respective side walls 20*e*, 20*f* of the box-like head holder 20 as the above-described two side portions, while the front head unit 21 is disposed between the two side walls 20*e*, 20*f*. That is, in the above-described embodiment, the heat dissipater 15, the bubble discharger 26 and the front heat unit 21 are fixed relative to the carriage 9 through the head holder 20. However, the carriage 9 may be modified to include the two side portions, so that the heat dissipater 15, the bubble discharger 26 and the front heat unit 21 are fixed directly to the carriage 9.

While the head holder 20 is fixed to the carriage 9 through the screw bolts in the above-described embodiment, the head holder 20 may be formed integrally with a portion or an entirety of the carriage 9. Irrespective of whether the head holder 20 and the carriage 9 are formed independently of each other or integrally with each other, it is also possible to consider that the head holder is included in the carriage and constitutes a part of the carriage.

In the above-described embodiment, the bubble discharger 26 is equipped with the valve members (each including the head portion 57 and the stem portion 58) disposed within the communication holes 56 which are held in communication with the second sub-chambers 39 of the damping chambers 27 as the bubble retainers. However, the bubble discharger 26 does not have to be necessarily equipped with the valve members, as long as the bubble discharger 26 is arranged to be capable of discharging the air bubbles from the second sub-chambers 39.

Figure 15:
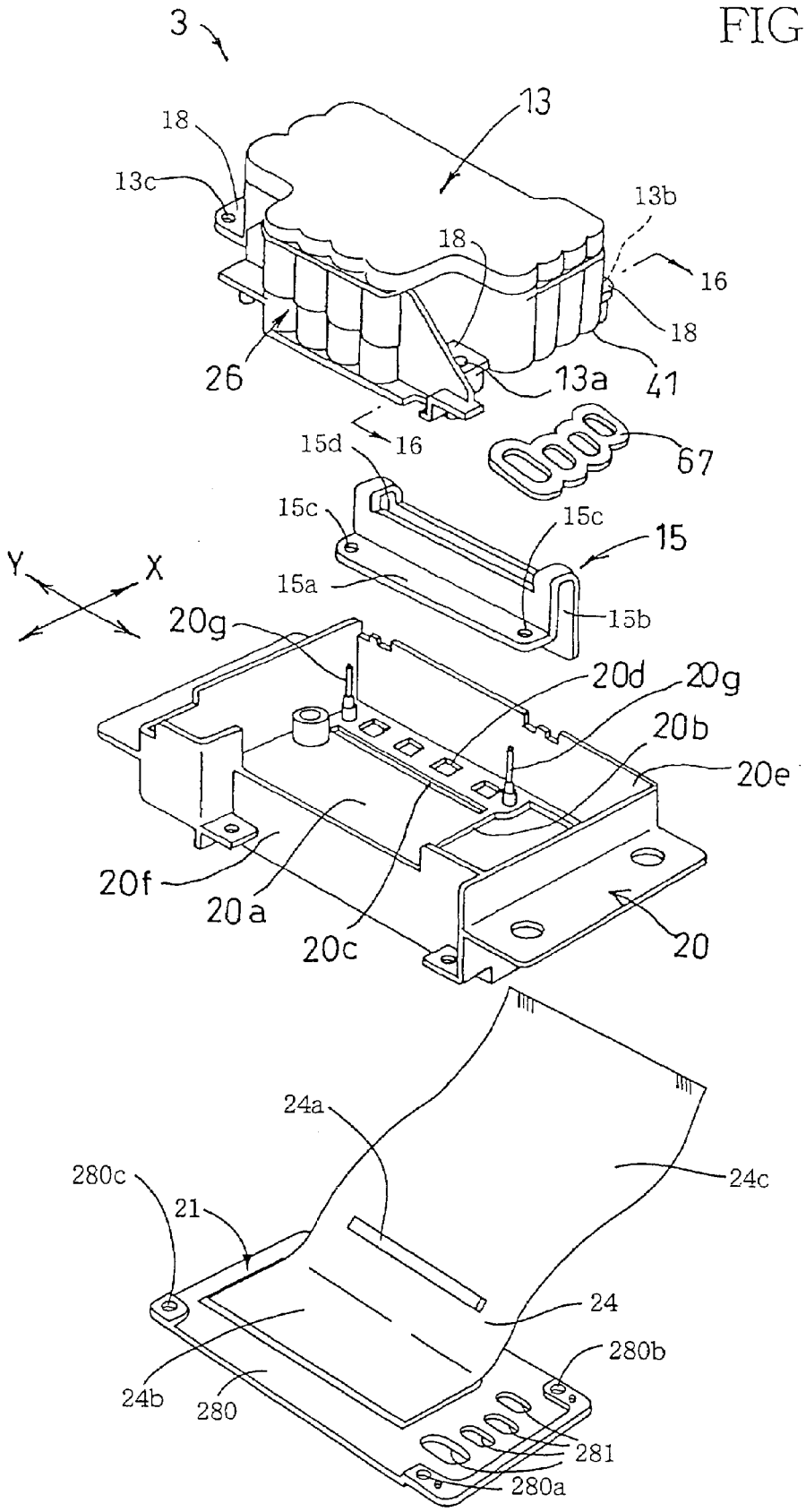
FIG. 15 is a perspective and exploded view of a modification of the printer head.
Figure 16:
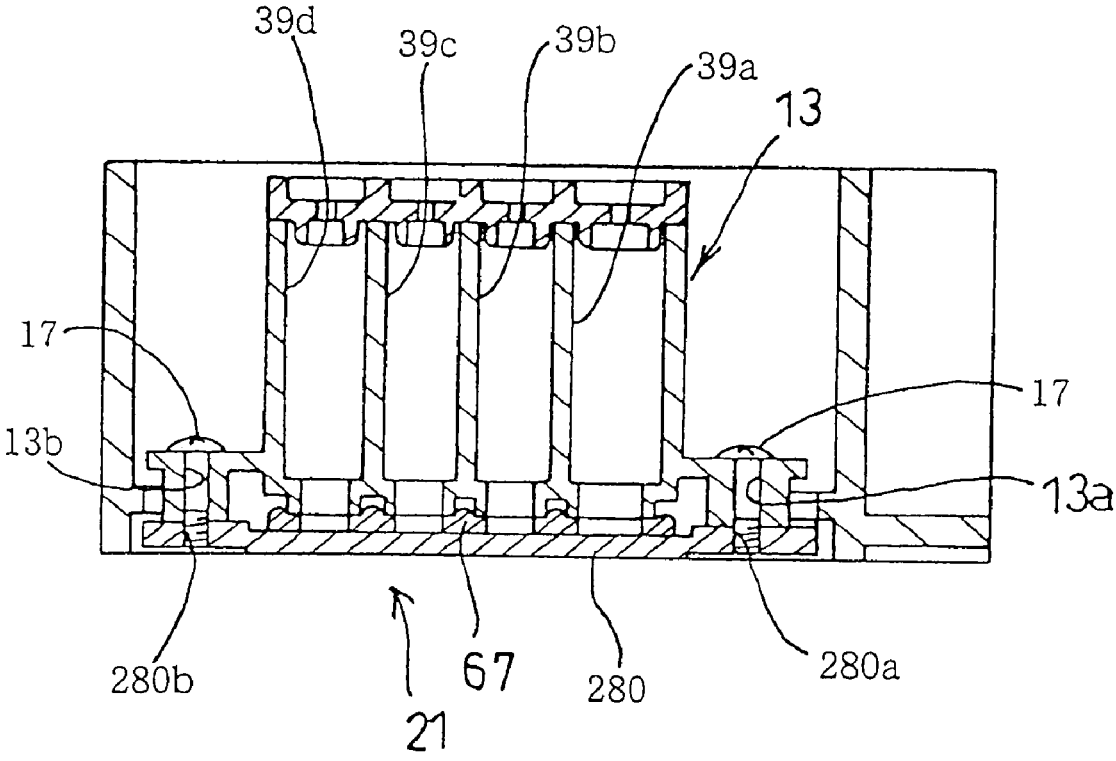
FIG. 16 is a cross sectional view taken along line 16-16 in FIG. 15.

In the above-described embodiment, the front head unit 21 and the damper unit 13 as the ink-channel defining unit are fixed relative to each other, with the reinforcement member 65 supporting or reinforcing the front head unit 21 being interposed therebetween. However, the reinforcement member 65 is not essential. FIGS. 15 and 16 show a modification of the printer head 3 in which the front head unit 21 and the damper unit 13 are fixed to each other without the reinforcement member 65 being interposed therebetween. That is, the two units 21, 13 are fixed to each other by the three screws 17 which are screwed into respective three tapped holes 280*a*-280*c* formed through a cavity unit 280 of the front head unit 21, such that each of the ink outlets 41 of the damper unit 13 is aligned with a corresponding one of ink inlets 281 of the cavity unit 280, and such that the front head unit 21 is fixed at its inside surface to the bottom wall 20*a* of the head holder 20. In this modification, the front head unit 21 is reinforced by the damper unit 13 which is fixed to the front head unit 21 by the three screws 17. Therefore, the front head unit 21 is given a high rigidity, like in the above-described embodiment. The fluid-tight connection of the ink inlets 281 and the ink outlets 41 can be established by two of the three screws 17 which are screwed into the above-described two tapped holes 280*a*, 280*b* for contributing to compress the elastic sealing member 67. In this sense, the tapped hole 280*c* which does not particularly contribute to compress the elastic sealing member 67 is not essential.

What is claimed is:

1. An inkjet printer comprising:

a front head unit having (i) an outside surface which is to be opposed to a print media, (ii) a plurality of nozzles which open in said outside surface;

a carriage which carries said front head unit and is reciprocatable in a primary scanning direction;

an ink supplier which supplies the ink from an ink storage container toward said nozzles therethrough;

a driver circuit which outputs a drive signal for driving said front head unit;

a heat dissipater which dissipates heat generated by said driver circuit;

a bubble retainer which retains a bubble generated in said ink supplier; and a bubble discharger which discharges the bubble from said bubble retainer, wherein said heat dissipater, said bubble discharger and said front head unit are mounted on said carriage, and are arranged in said primary scanning direction;

wherein said carriage has two side portions which are opposed to each other in said primary scanning direction, wherein said front head unit is located between said two side portions of said carriage, and wherein said heat dissipater is located in the vicinity of one of said two side portions while said bubble discharger is located in the vicinity of the other of said two side portions.

2. The inkjet printer according to claim 1, further comprising a head holder which holds said front head unit and which is included in said carriage, wherein said two side portions of said carriage are provided by portions of said head holder.

3. The inkjet printer according to claim 1, wherein said heat dissipater has a contact portion which is held in contact with said driver circuit, and an exposed portion which is contiguous to said contact portion and which is located outwardly of said carriage as viewed in said primary scanning direction.

4. The inkjet printer according to claim 3, wherein said heat dissipater bridges a side wall of said carriage, such that said contact portion and said exposed portion of said heat dissipater extend along an inner surface and an outer surface of said side wall, respectively.

5. The inkjet printer according to claim 4, wherein said driver circuit is mounted on a flexible flat cable which is provided on said front head unit, and wherein said drive circuit is interposed between said carriage and said contact portion of said heat dissipater.

6. The inkjet printer according to claim 1, wherein said ink supplier includes an ink supply tube though which the ink is supplied from said ink storage container toward said plurality of nozzles.

7. An inkjet printer comprising:

a front head unit having (i) an outside surface which is to be opposed to a print media, (ii) a plurality of nozzles which open in said outside surface;

a carriage which carries said front head unit and is reciprocatable in a primary scanning direction;

an ink supplier which supplies the ink from an ink storage container toward said nozzles therethrough;

a driver circuit which outputs a drive signal for driving said front head unit;

a heat dissipater which dissipates heat generated by said driver circuit;

a bubble retainer which retains a bubble generated in said ink supplier; and a bubble discharger which discharges the bubble from said bubble retainer, wherein said heat dissipater, said bubble discharger and said front head unit are mounted on said carriage, and are arranged in said primary scanning direction, wherein said heat dissipater has a contact portion which is held in contact with said driver circuit, and an exposed portion which is contiguous to said contact portion and which is located outwardly of said carriage as viewed in said primary scanning direction, wherein said heat dissipater bridges a side wall of said carriage, such that said contact portion and said exposed portion of said heat dissipater extend along an inner surface and an outer surface of said side wall, respectively;

wherein said heat dissipater is provided by a metallic plate member which is bent about a line parallel to a major surface of said metallic plate member such that said metallic plate member includes a portion in which said major surface is not parallel to said primary scanning direction, and wherein said exposed portion of said heat dissipater is provided by said portion of said metallic plate member.

8. An inkjet printer comprising:

a front head unit having (i) an outside surface which is to be opposed to a print media, (ii) a plurality of nozzles which open in said outside surface;

a carriage which carries said front head unit and is reciprocatable in a primary scanning direction;

an ink supplier which supplies the ink from an ink storage container toward said nozzles therethrough;

a driver circuit which outputs a drive signal for driving said front head unit;

a heat dissipater which dissipates heat generated by said driver circuit;

a bubble retainer which retains a bubble generated in said ink supplier; and a bubble discharger which discharges the bubble from said bubble retainer, wherein said heat dissipater, said bubble discharger and said front head unit are mounted on said carriage, and are arranged in said primary scanning direction, and wherein said bubble discharger includes a valve member that is selectively placed in an open state and a closed state, so as to selectively open and close a communication passage communicating said bubble retainer with an exterior, said inkjet printer further comprising a member that is operable to place said valve member in said open state, so as allow the bubble to be discharged from said bubble retainer to the exterior through said bubble discharger.

* * * * *